US011803135B2

(12) United States Patent
Nakamura et al.

(10) Patent No.: US 11,803,135 B2
(45) Date of Patent: Oct. 31, 2023

(54) TRANSFER DEVICE AND IMAGE FORMING APPARATUS INCLUDING PHOTOCONDUCTORS, A BELT, AND PRIMARY TRANSFER ROLLERS

(71) Applicants: Nagisa Nakamura, Shizuoka (JP); Koji Kiryu, Tokyo (JP); Masahiro Ashikawa, Kanagawa (JP); Hiroaki Takagi, Kanagawa (JP); Jumpei Yamaguchi, Kanagawa (JP); Masashi Kasamai, Kanagawa (JP); Kanji Ubukata, Kanagawa (JP)

(72) Inventors: Nagisa Nakamura, Shizuoka (JP); Koji Kiryu, Tokyo (JP); Masahiro Ashikawa, Kanagawa (JP); Hiroaki Takagi, Kanagawa (JP); Jumpei Yamaguchi, Kanagawa (JP); Masashi Kasamai, Kanagawa (JP); Kanji Ubukata, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 17/876,562

(22) Filed: Jul. 29, 2022

(65) Prior Publication Data

US 2023/0042229 A1 Feb. 9, 2023

(30) Foreign Application Priority Data

Aug. 3, 2021 (JP) ..... 2021-127759

(51) Int. Cl.

| | |
|---|---|
| ***G03G 5/16*** | (2006.01) |
| ***G03G 15/00*** | (2006.01) |
| ***G03G 15/16*** | (2006.01) |

(52) U.S. Cl.

CPC ..... *G03G 15/1615* (2013.01); *G03G 15/167* (2013.01); *G03G 15/5008* (2013.01)

(58) Field of Classification Search

CPC ..... G03G 15/1615; G03G 15/167; G03G 15/5008

See application file for complete search history.

(56) References Cited

U.S. PATENT DOCUMENTS

| | | | | |
|---|---|---|---|---|
| 8,571,450 | B2 * | 10/2013 | Ichihashi | G03G 15/161 399/302 |
| 2006/0222418 | A1 * | 10/2006 | Ebara | G03G 15/011 399/301 |
| 2010/0239293 | A1 | 9/2010 | Ishizaki et al. | |
| 2012/0237240 | A1 | 9/2012 | Kiryu | |
| 2014/0255063 | A1 | 9/2014 | Kiryu | |

(Continued)

FOREIGN PATENT DOCUMENTS

| | | |
|---|---|---|
| JP | 2012-185292 | 9/2012 |

*Primary Examiner* — Joseph S Wong
(74) *Attorney, Agent, or Firm* — XSENSUS LLP

(57) ABSTRACT

A transfer device includes a plurality of photoconductors, a belt, a plurality of primary transfer rollers and control circuitry. The plurality of primary transfer rollers is disposed for the plurality of photoconductors, respectively. The plurality of primary transfer rollers brings the belt into contact with or separate the belt from the plurality of photoconductors. The control circuitry causes at least one of the plurality of primary transfer rollers to press against a corresponding at least one of the plurality of photoconductors to shift a printing mode.

14 Claims, 26 Drawing Sheets

(56) References Cited

U.S. PATENT DOCUMENTS

| | | | |
|---|---|---|---|
| 2017/0357200 | A1 | 12/2017 | Takagi et al. |
| 2019/0286017 | A1 | 9/2019 | Nakamoto et al. |
| 2021/0278785 | A1 | 9/2021 | Ashikawa |

* cited by examiner

TRANSFER DEVICE AND IMAGE FORMING APPARATUS INCLUDING PHOTOCONDUCTORS, A BELT, AND PRIMARY TRANSFER ROLLERS

CROSS-REFERENCE TO RELATED APPLICATION

This patent application is based on and claims priority pursuant to 35 U.S.C. § 119(a) to Japanese Patent Application No. 2021-127759, filed on Aug. 3, 2021, in the japan Patent Office, the entire disclosure of which is hereby incorporated by reference herein.

BACKGROUND

Technical Field

Embodiments of the present disclosure relate to a transfer device and an image forming apparatus.

Related Art

In the related art, a full-color tandem-type image forming apparatus is known that performs full-color image formation. For example, the full-color tandem-type image forming, apparatus employs a method of image formation using five image forming units including four image forming units of yellow (Y), magenta (M), cyan (C), and black (K) toners, and one more image forming unit of foaming toner for braille, fluorescent toner, transparent toner for improving gloss, or ferromagnetic toner.

When the image forming apparatus switches from a full-color mode to a special monochrome mode and a large number of sheets is to be printed in the special monochrome mode after the switching, the image forming apparatus separates the image forming units of yellow (Y), magenta (M), and cyan (C) toners from an intermediate transfer unit and stops the operations of the image forming units. Thus, the image forming apparatus controls a separating operation of primary transfer rollers in accordance with the number of sheets to be printed at the time of switching, A technique in the related art is known to prevent a failure that is likely to occur at the time of switching an image mode by such control described above so that the service life and productivity of the image forming units are enhanced.

SUMMARY

Embodiments of the present disclosure described herein provide a novel transfer device including a plurality of photoconductors, a belt, a plurality of primary transfer rollers and control circuitry. The plurality of primary transfer rollers is disposed for the plurality of photoconductors, respectively. The plurality of primary transfer rollers brings the belt into contact with or separate the belt from the plurality of photoconductors. The control circuitry causes at least one of the plurality of primary transfer rollers to press against a corresponding at least one of the plurality of photoconductors to shift a printing mode.

Embodiments of the present disclosure described herein provide a novel image forming apparatus including the transfer device.

BRIEF DESCRIPTION OF THE. DRAWINGS

A more complete appreciation of the disclosure and many of the attendant advantages and features thereof can be readily obtained and understood from the following detailed description with reference to the accompanying drawings, wherein.

Figure 1:
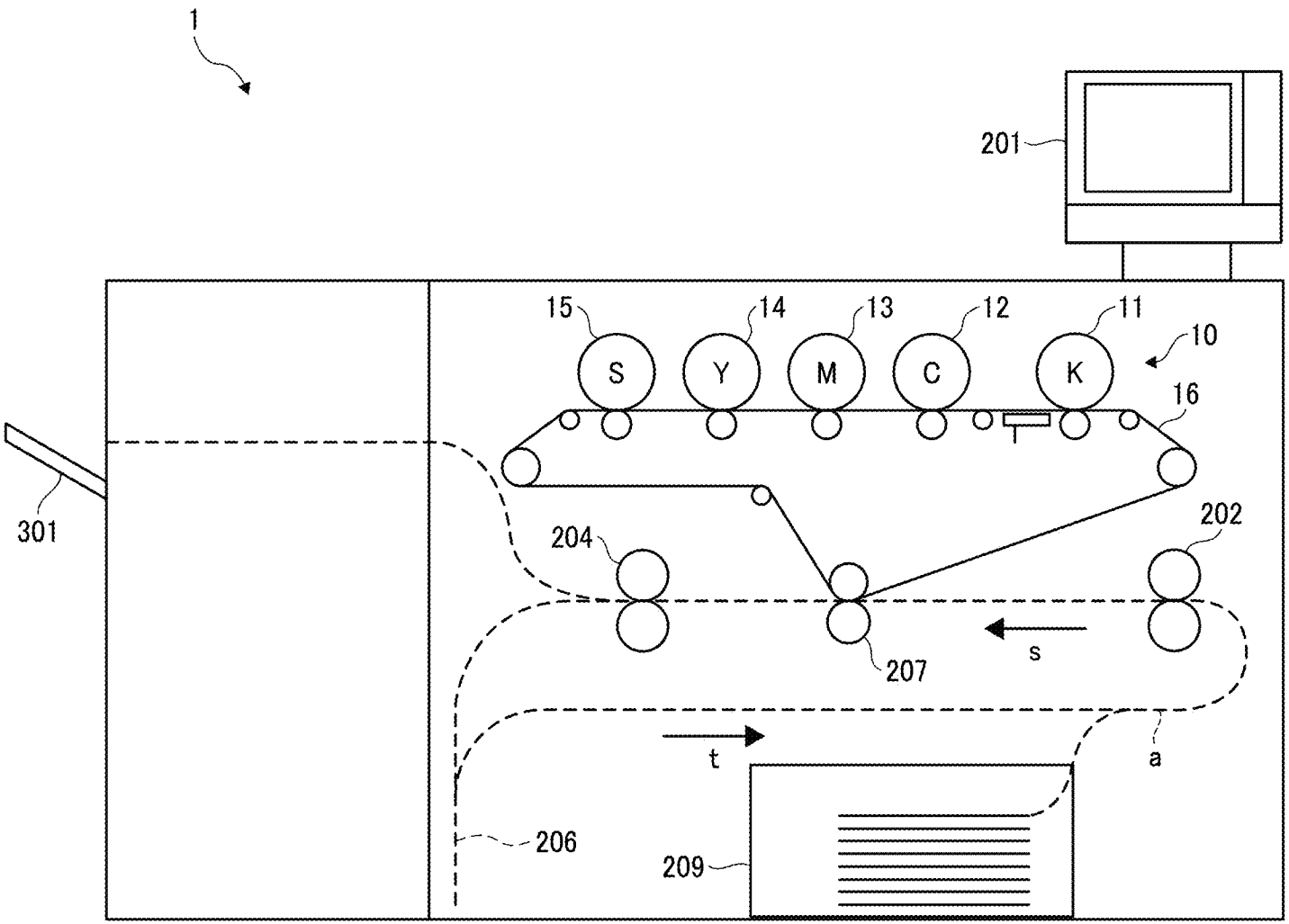
FIG. 1 is a diagram illustrating an example of an image forming apparatus.

The accompanying drawings are intended to depict embodiments of the present invention and should not be interpreted to limit the scope thereof. The accompanying drawings are not to be considered as drawn to scale unless explicitly noted. Also, identical or similar reference numerals designate identical or similar components throughout the several views.

DETAILED DESCRIPTION

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

Referring now to the drawings, embodiments of the present disclosure are described below. As used herein, the singular forms "a" "an," and "the" are intended to include the plural forms as well, unless the context clearly indicates otherwise.

Descriptions are given of a transfer device and an image forming apparatus according to an embodiment of the present disclosure, with reference to the following figures. Note that the embodiments are not limited to the specific examples described below.

Example of Image Forming Apparatus

FIG. 1 is a schematic diagram illustrating an example of a hardware configuration of an image forming apparatus 1.

The image forming apparatus 1 includes an operation panel 201, a transfer device 10, a secondary transfer roller 207, a sheet feeding device 209, a conveyance roller pair 202, a fixing roller pair 204, a sheet reverse passage 206, and an output tray 301.

The operation panel 201 is an operation display unit that enables a user to input various operations to the image forming apparatus 1 and displays various screens.

The transfer device 10 includes five photoconductors 11 to 15 and a belt 16. A toner image is formed on each of the photoconductors 11 to 15 by an image forming process (a charging process, an exposing process, a developing process, a transfer process, and a cleaning process). The toner image formed on each of the photoconductors 11 to 15 is transferred onto the belt 16. After the toner images of the photoconductors 11 to 15 are transferred onto the belt 16 while being superimposed on top of another, the belt 16 conveys the composite toner image (full-color toner image) to a secondary transfer position of the secondary transfer roller 207.

The sheet feeding device 209 accommodates a plurality of recording media to be processed (a conveyed objects) in a superposed manner and feeds each recording medium of the plurality of recording media one by one. Examples of the recording medium include recording paper (transfer paper), However, the recording medium is not limited to this, and examples of the recording medium ma include media capable of recording images such as coated paper, thick paper, overhead projector (OUP) sheets, plastic films, and copper foil.

The conveyance roller pair 202 conveys the recording medium fed by the sheet feeding device 209 in a direction indicated by arrow "s" on a conveyance passage "a".

The secondary transfer roller 207 collectively transfers the full-color toner image conveyed by the belt 16 onto the recording medium conveyed by the conveyance roller pair 202 at the secondary transfer position.

The fixing roller pair 204 fixes the full-color toner image on the recording medium by heating and pressurizing the recording medium onto which the full-color toner image is transferred.

In the case of single-sided printing, the image forming apparatus 1 sends a printed material, which is the recording medium on which the fill-color toner images are fixed, to the output tray 301. In the case of double-sided printing, the image forming apparatus 1 sends the recording medium, on which the full-color toner images have been fixed, to the sheet reverse passage 206.

By switching back the fed recording medium, the front and back faces of the recording medium are reversed in the sheet reverse passage 206. Then, the reversed recording medium is conveyed in the direction of the arrow "t". After the recording medium conveyed through the sheet reverse passage 206 is conveyed again by the conveyance roller pair 202, a full-color toner image is transferred onto the back face of the recording medium opposite to the previously transferred face (front face) by the secondary transfer roller 207. The transferred full-color toner image transferred on the back face of the recording medium is fixed to the back face by the fixing roller pair 204, and the recording medium is sent as printing material to the output tray 301. The output tray 301 stacks the recording medium ejected through the conveyance passage "a".

Example of Transfer Device

Figure 2:
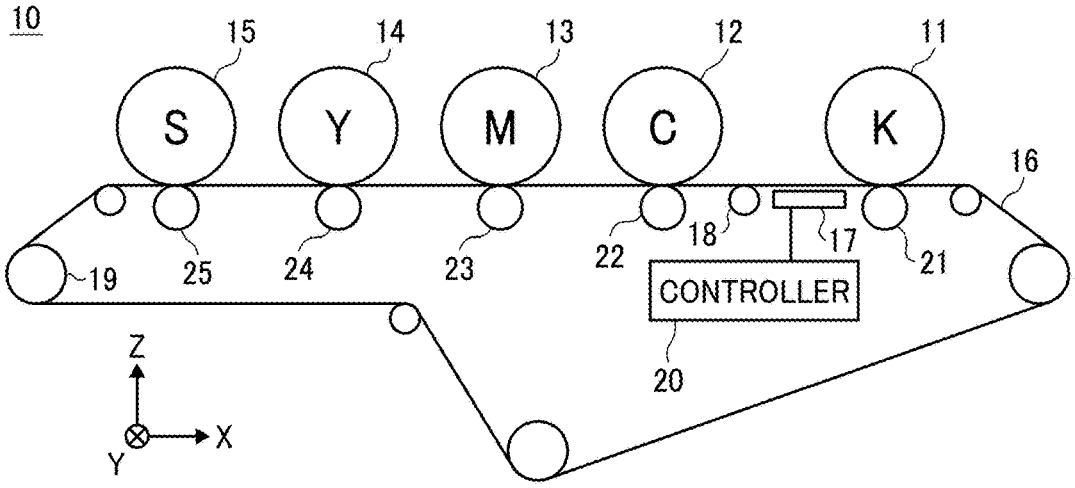
FIG. 2 is a diagram illustrating an example of a transfer device.

FIG. 2 is a diagram illustrating an example of a transfer device. For example, the transfer device 10 includes the five photoconductors. The five photoconductors are referred to as a first photoconductor 11, a second photoconductor 12, a third photoconductor 13, a fourth photoconductor 14, and a fifth photoconductor 15 in order from the right in FIG. 2.

The five photoconductors are separately disposed for different colors. Specifically, the first photoconductor 11 is for black (K). The second photoconductor 12 is for cyan (C). The third photoconductor 13 is for magenta (M). The fourth photoconductor 14 is for yellow (Y).

The fifth photoconductor 15 is for a special (S) color. The special color is, for example, white image, clear, or a color other than C, M, Y, and K.

Note that the order of the photoconductors is not limited to the order illustrated in FIG. 2. For example, the order of the first photoconductor 11 and the fifth photoconductor 15 may be switched. The photoconductors may have colors other than the colors illustrated in FIG. 2.

The transfer device 10 includes the belt 16. The belt 16 has an endless loop wound around multiple rollers.

The transfer device 10 preferably includes an optical sensor 17. For example, the optical sensor 17 is disposed close to the belt 16. In other words, the optical sensor 17 is disposed at a position where the optical sensor 17 detects marks formed on the belt 16. Note that the optical sensor 17 may be disposed at a position other than the position illustrated in FIG. 2. For example, the optical sensor 17 may be disposed near the fifth photoconductor 15.

Preferably, the transfer device 10 further includes a support 18. Note that the support 18 may be disposed at a position other than that illustrated in FIG. 2. For example, the support 18 serves as a driven roller. However, the support 18 may serve as a driving roller.

The transfer device 10 preferably includes a driving roller 19. For example, the driving roller 19 is an actuator such as a motor. The driving roller 19 rotates to convey the belt 16. Note that the driving roller 19 may be disposed at a position other than the position illustrated in FIG. 2. Further, the transfer device 10 may include a plurality of driving rollers including the driving roller 19.

The transfer device 10 includes a primary transfer roller for each photoconductor. Each primary transfer roller is disposed so as to nip the belt 16 with a corresponding photoconductor. A first primary transfer roller 21 is disposed facing the first photoconductor 11 via the belt 16. A second primary transfer roller 22 is disposed facing the second photoconductor 12 via the belt 16. A third primary transfer roller 23 is disposed facing the third photoconductor 13 via the belt 16. A third primary transfer roller 24 is disposed facing the fourth photoconductor 14 via the belt 16. A fifth primary transfer roller 25 is disposed facing the fifth photoconductor 15 via the belt 16.

The transfer device 10 includes a controller 20. The controller 20 is an example of an arithmetic unit and a control unit. The transfer device 10 may include a plurality of arithmetic units and a plurality of control units.

The transfer device 10 may further include devices other than the devices illustrated in FIG. 2.

Examples of States of Photoconductor, Belt, and Primary Transfer Roller

For example, the photoconductor, the belt, and the primary transfer roller of the transfer device 10 change the positions depending on the type of printing.

Figure 3:
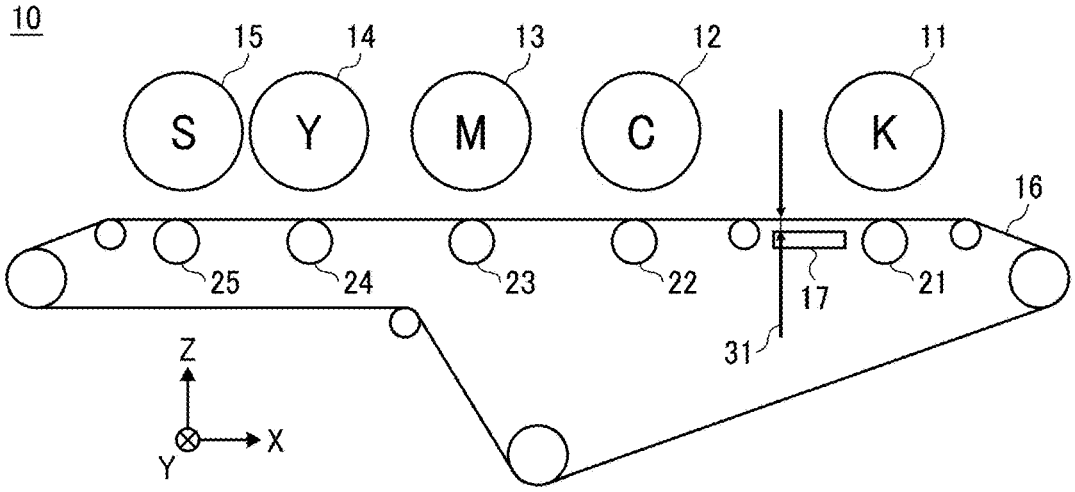
FIG. 3 is a diagram illustrating an example of a non-printing state.

FIG. 3 is a diagram illustrating an example of the positions of the parts in a non-printing state. When printing is not performed, for example, the belt 16 is separated from each of the first photoconductor 11 to the fifth photoconductor 15. As illustrated in FIG. 3, none of the first photoconductor 11 to the fifth photoconductor 15 is in contact with the belt 16 in the non-printing state. This state may be referred to as a "fully separated state".

Further, a distance between the optical sensor 17 and the belt 16 in the fully separated state is referred to as a "first distance 31".

Figure 4:
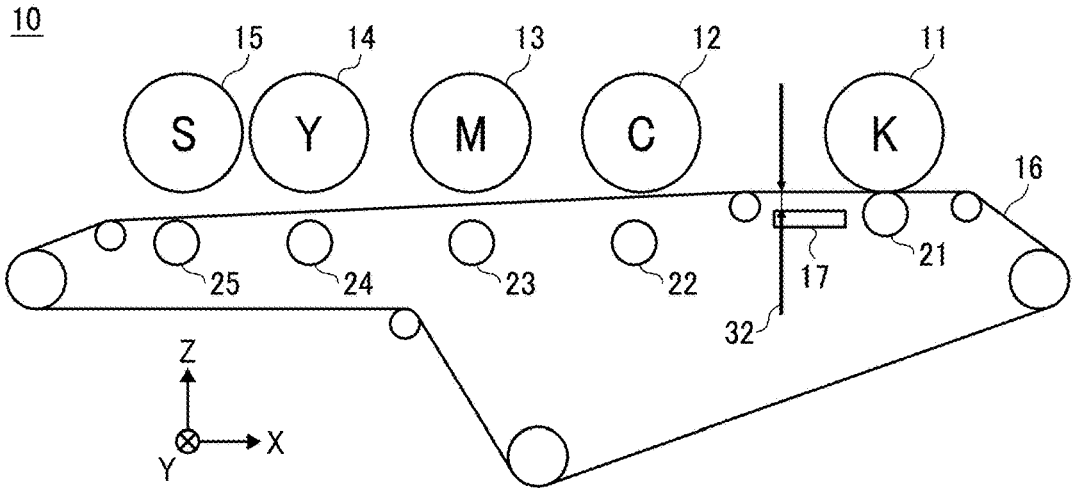
FIG. 4 is a diagram illustrating an example of a first printing state.

FIG. 4 is a diagram illustrating an example of a first printing state. As compared to the non-printing printing state, the first printing state is different from the non-printing state in that the first photoconductor 11 and the belt 16 are in contact with each other.

In the first printing state, the belt 16 is lifted by the first primary transfer roller 21. In this state, printing by the first photoconductor 11 may be performed. In other words, printing in black may be performed.

In the first printing state, the distance between the optical sensor 17 and the belt 16 is different from that in the fully separated state. The distance between the optical sensor 17 and the belt 16 in the first printing state is referred to as a "second distance 32".

Figure 5:
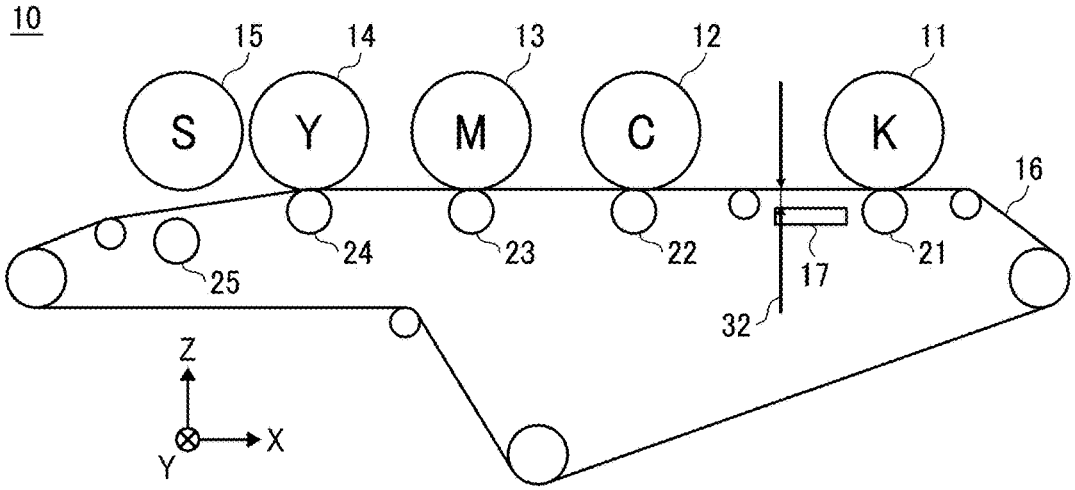
FIG. 5 is a diagram illustrating an example of a second printing state.

FIG. 5 is a diagram illustrating an example of a second printing state. As compared to the first printing state, the second photoconductor 12, the third photoconductor 13, and the fourth photoconductor 14 are further in contact with the belt 16 in the second printing state.

In the second printing state, the belt 16 is lifted by the first primary transfer roller 21, the second primary transfer roller 22, the third primary transfer roller 23, and the fourth primary transfer roller 24. In this state, printing in both black and full color may be performed using the first photoconductor 11 to the fourth photoconductor 14.

Further, the distance between the optical sensor 17 and the belt 16 in the second printing state corresponds to the second distance 32 as in the first printing state.

Figure 6:
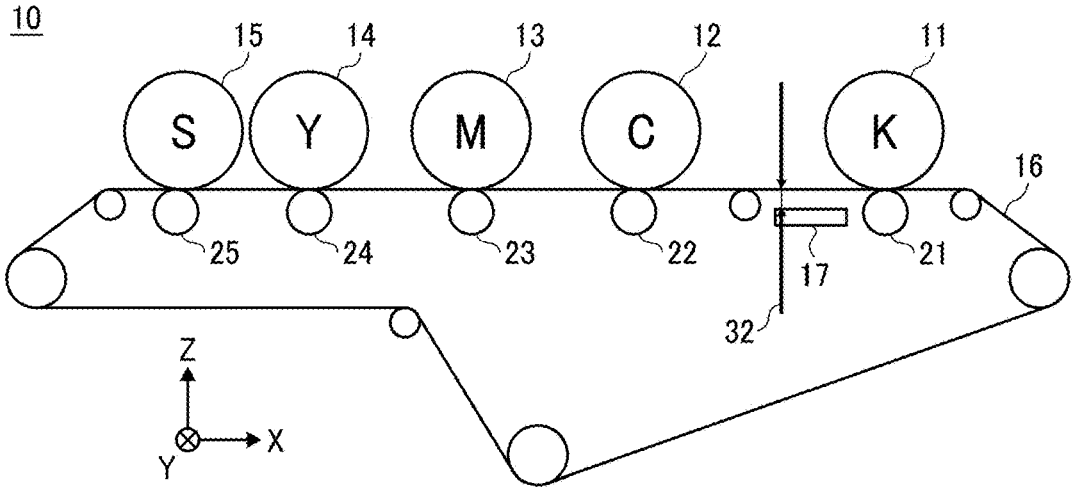
FIG. 6 is a diagram illustrating an example of a third printing state.

FIG. 6 is a diagram illustrating an example of a third printing state. As compared to the second printing state, the fun photoconductor 15 is further in contact with the belt 16 in the third printing state.

In the third printing state, the belt 16 is lifted by the first primary transfer roller 21, the second primary transfer roller 22, the third primary transfer roller 23, the fourth primary transfer roller 24, and the fifth primary transfer roller 25. In this state, printing in each of black, full color, and special color may be performed using the first photoconductor 11 to the fifth photoconductor 15.

Further, the distance between the optical sensor 17 and the belt 16 in the third printing state corresponds to the second distance 32 as in the first printing state.

Figure 7:
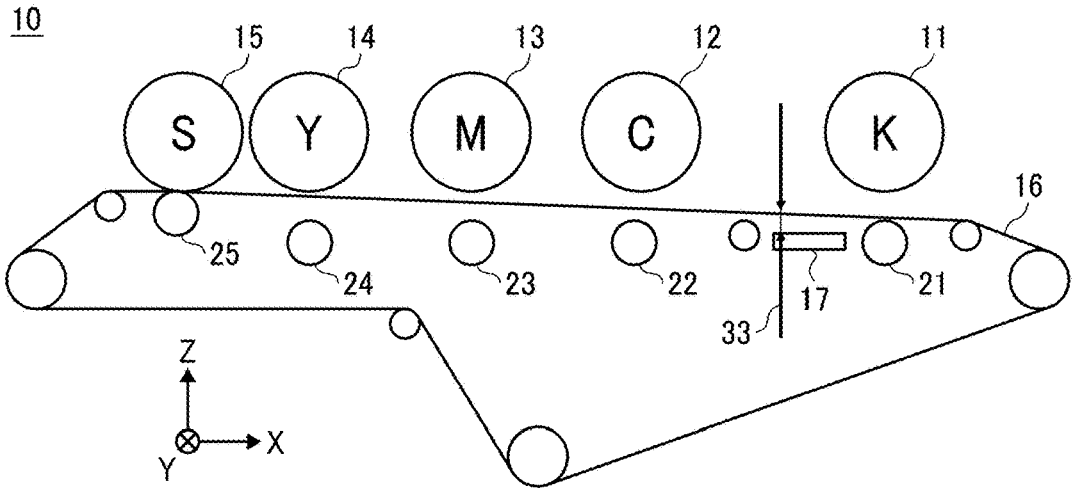
FIG. 7 is a diagram illustrating an example of a fourth printing state.

FIG. 7 is a diagram illustrating an example of a fourth printing state. As compared to the third printing state, the fifth photoconductor 15 is in contact with the belt 16 and the rest of the photoconductors (i.e., the first photoconductor 11 to the fourth photoconductor 14) are separated from the belt 16 in the fourth printing state.

In the fourth printing state, the belt 16 is lifted by the fifth primary transfer roller 25. In this state, printing in special color may be performed using the fifth photoconductor 15.

In the fourth printing state, the distance between the optical sensor 17 and the belt 16 is different from the distance in the first printing state. The distance between the optical sensor 17 and the belt 16 in the fourth printing state is referred to as a "third distance 33".

Figure 8:
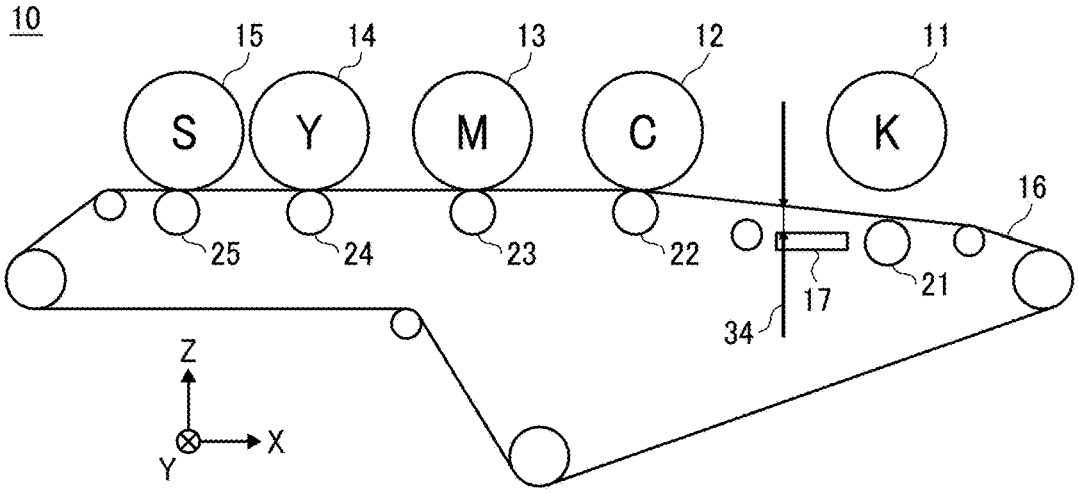
FIG. 8 is a diagram illustrating an example of a fifth printing state.

FIG. 8 is a diagram illustrating an example of a fifth printing state. As compared to the fourth printing state, each of the second photoconductor 12 to the fifth photoconductor 15 is in contact with the belt 16 and the first photoconductor 11 is separated from the belt 16 in the fifth printing state.

In the fifth printing state, the belt 16 is lifted by the second primary transfer roller 22 to the fifth primary transfer roller 25. In this state, printing in both full color and special color may be performed using the second photoconductor 12, the third photoconductor 13, the fourth photoconductor 14, and the fifth photoconductor 15.

In the fifth printing state, the distance between the optical sensor 17 and the belt 16 is different from the distance in the first printing state. The distance between the optical sensor 17 and the belt 16 in the fifth printing state is referred to as a "fourth distance 34".

Changing the distance between the optical sensor 17 and the belt 16, for example, the first distance 31 to the fourth distance 34, may cause the following results.

Figure 9:
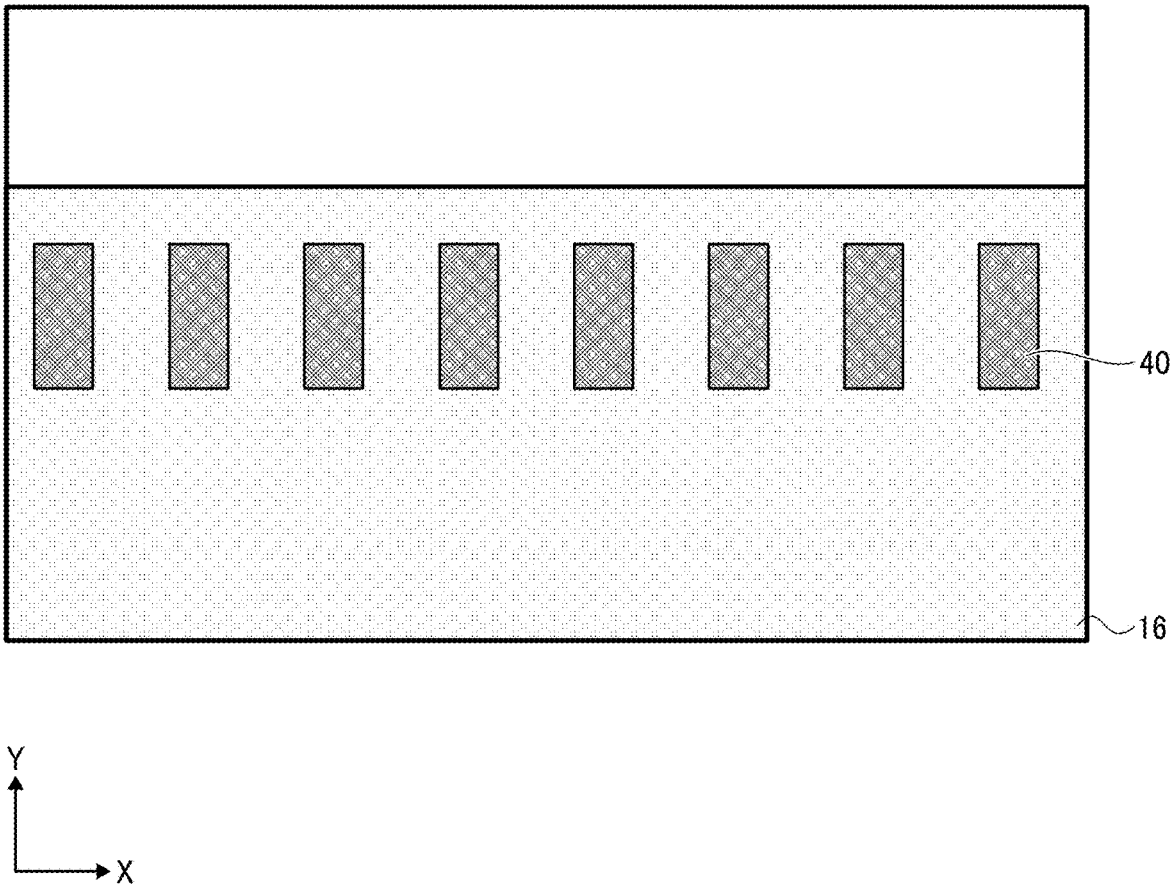
FIG. 9 is a diagram illustrating an example of placing marks on a belt.

FIG. 9 is a diagram illustrating an example of placing marks on a belt. For example, marks 40 are placed on the back side of the belt 16, which is the lower side in the Z-axis of the belt 16, as illustrated in FIG. 9.

The results of the reading by the optical sensor 17 depend on the distance between the optical sensor 17 and the belt 16 as described below.

Figure 10:
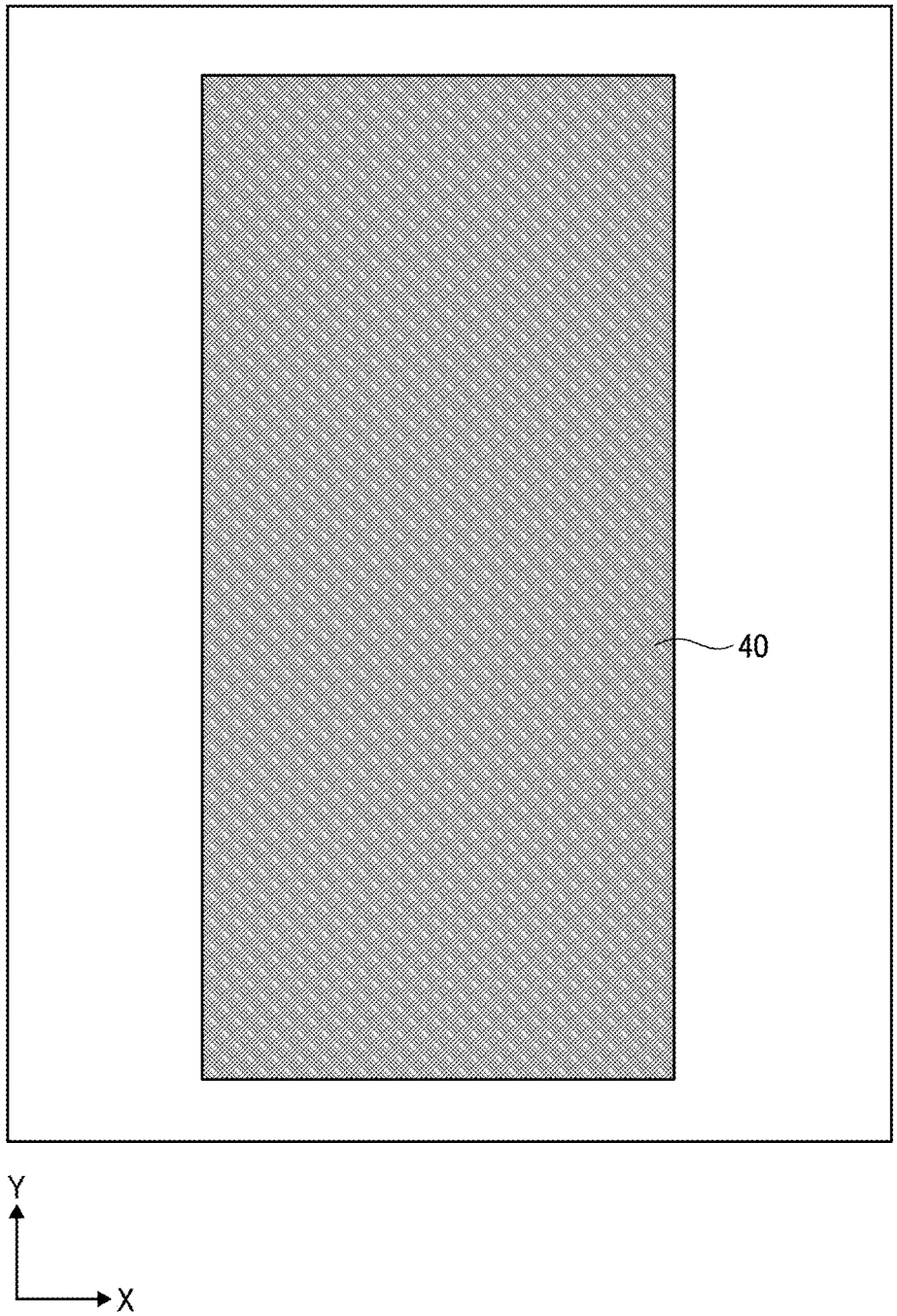
FIG. 10 is a diagram illustrating an example of a result of reading the marks at an appropriate distance.

FIG. 10 is a diagram illustrating an example of the result of the reading the marks 40 at an appropriate distance. For example, a description is given of an example of the reading result of a mark 40 appropriately set with the second distance 32. In other words, it is assumed that the optical sensor 17 is in focus at the second distance 32.

In such a setting, the outline of the mark 40 is clearly read at the second distance 32 as illustrated in FIG. 10, i.e., in any one of the first printing state, the second printing state, and the third printing state.

Figure 11:
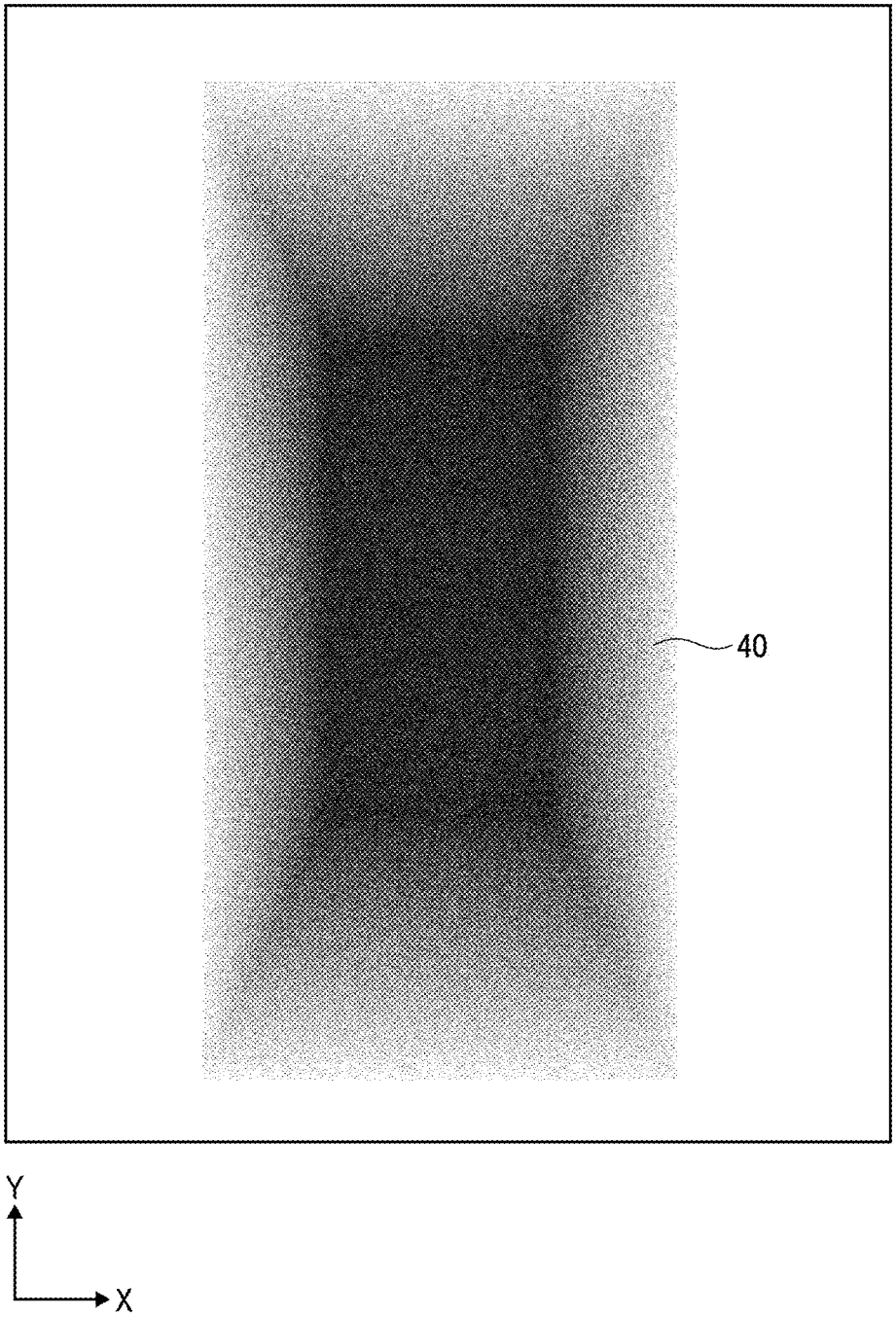
FIG. 11 is a diagram illustrating an example of a result of reading the marks at an inappropriate distance.

FIG. 11 is a diagram illustrating an example of a result of reading the marks 40 at an inappropriate distance. In a case where the distance is other than the second distance 32, the outline of the mark 40 is not clearly read as illustrated in FIG. 11.

For example, a conveyance speed of the belt 16 is calculated based on the number of marks 40 detected per unit time. Due to this configuration, in a case where the outline of the mark 40 is unclear and the detection result is unstable, the calculation result may be unstable. On the other hand, in a case where the outline of the mark 40 is clear as illustrated in FIG. 10, the mark 40 may be detected with high accuracy.

Thus, it is preferable that the distance between the optical sensor 17 and the belt 16 is changed by, for example, moving the optical sensor 17, as described below.

Figure 12:
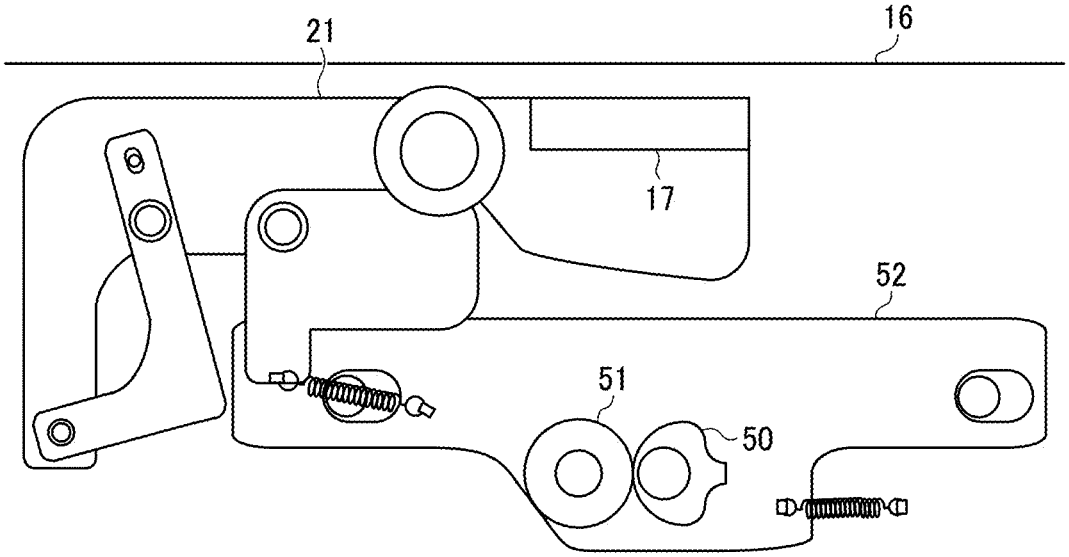
FIG. 12 is a diagram illustrating an example of a mechanism for operating an optical sensor and a primary transfer roller.

FIG. 12 is a diagram illustrating an example of a mechanism for operating the optical sensor 17 and the first primary transfer roller 21. For example, the transfer device 10 includes a cam 50 and a bearing 51 that are moved as described below. A description is given of an example of the primary transfer roller with the first primary transfer roller 21.

Figure 13:
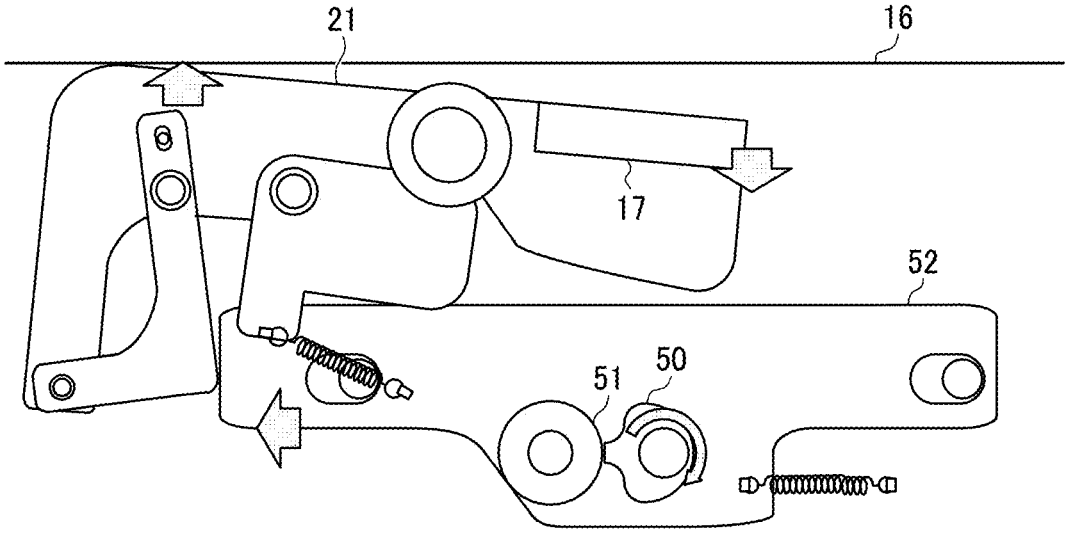
FIG. 13 is a diagram illustrating an example of the mechanism where the optical sensor and the primary transfer roller are moved.

FIG. 13 is a diagram illustrating an example of the mechanism where the optical sensor 17 and the first primary transfer roller 21 are moved. As the cam 50 makes a half turn, the state illustrated in FIG. 12 is changed to the state illustrated in FIG. 13. In response to this half turn, the cam 50 pushes the bearing 51 (toward the left direction in FIG. 13. The bearing 51 is embedded in a sheet metal 52. Due to this configuration, when the bearing 51 is pushed by the cam 50, the sheet metal 52 slides. As the sheet metal 52 is slid in this manner, the first primary transfer roller 21 may bring the belt 16 into contact with or separate the belt 16 from the first photoconductor 11.

At the same time, the optical sensor 17 moves in accordance with the slide of the sheet metal 52. Specifically, as the first primary transfer roller 21 moves upward in FIG. 13, the optical sensor 17 moves downward in FIG. 13. As described above, the mechanism moves the optical sensor 17 and the first primary transfer roller 21 in vertically opposite directions.

In other words, the mechanism illustrated in the FIG. 12 and FIG. 13 includes a single driving source that operates for rotating the cam 50. The single driving source may be an actuator such as a motor. As described above, it is preferable that the optical sensor 17 and the first primary transfer roller 21 share a common driving source.

Employing such a common driving source can reduce the number of parts of the driving source. Such a reduction in the number of parts of the driving source may reduce the cost of the transfer device 10. Further, the reduction in the number of parts of the driving source may reduce the space in the transfer device 10.

In a case where the first primary transfer roller 21 is at the fixed position, the optical sensor 17 is also at the fixed position. As described above, if the distance between the optical sensor 17 and the belt 16 is not changed, the initial position of the optical sensor 17 is set to an appropriate distance for detecting the mark 40. Then, the optical sensor 17 senses a target such as the marks through a lens and acquires an image of the target. In the fully separated state, the distance between the belt 16 and the optical sensor 17 is changed from the initial position. Then, the target in the correct focus at the initial position becomes out of focus. As a result, the outline of the mark 40 becomes unclear, which makes it difficult to clearly read the mark 40. Thus, in the fully separated state, the outline of the mark 40 may be difficult to be clearly read. To address this inconvenience, it is preferable to avoid the fully separated state.

Example of Mode Shift

The mode refers to, for example, a method of performing image formation in color, monochrome, special color, or a combination of the colors. Descriptions are given of an example of the shift from a mode for printing with the first photoconductor 11 to a mode for priming with the second photoconductor 12, the third photoconductor 13, the fourth photoconductor 14, and the fifth photoconductor 15. In other words, when the mode is shifted from the first printing state to the fifth printing state, the primary transfer roller is controlled so as to perform a first sequence as described below.

Example of First Sequence

Figure 14:
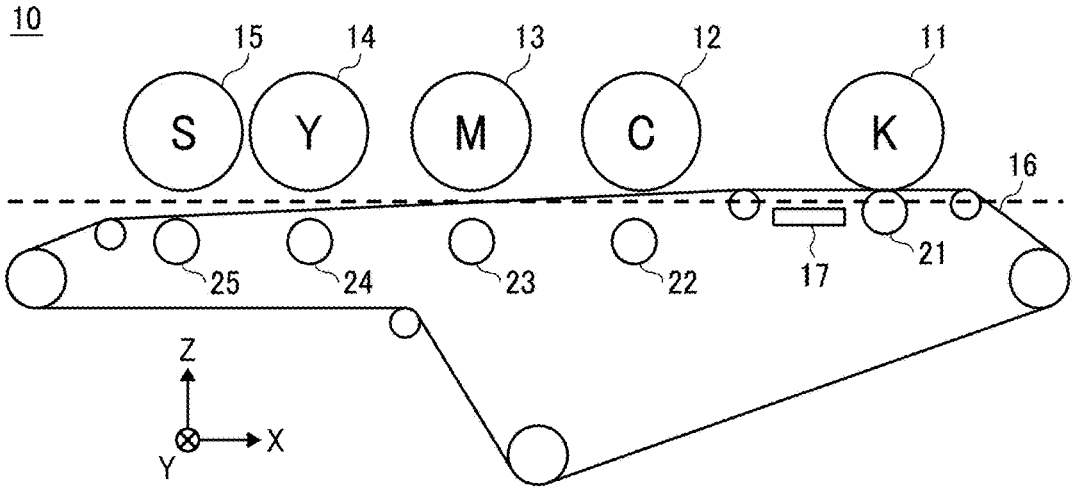
FIG. 14 is a diagram illustrating an example of a first sequence (part 1)

FIG. 14 is a diagram illustrating an example of the first sequence (part 1). First, the first printing state is a state as illustrated in FIG. 4. Next, the transfer device 10 brings each of the first photoconductor 11 to the fifth photoconductor 15 into contact with the belt 16 as described below. Broken lines in FIGS. 14 to 57 indicate whether the photoconductors are separated from the belt 16 or are in contact with the belt 16.

Figure 15:
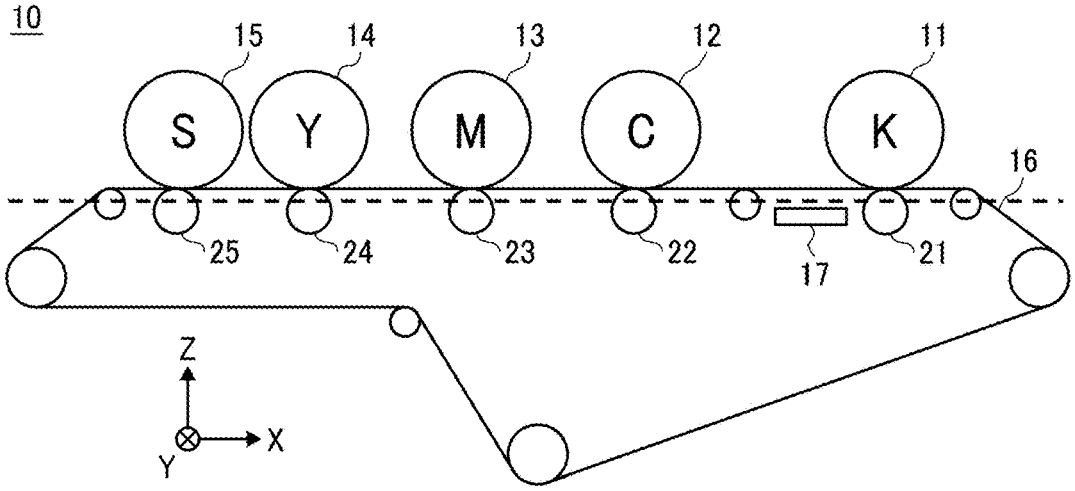
FIG. 15 is a diagram illustrating an example of the first sequence (part 2)

FIG. 15 is a diagram illustrating an example of the first sequence (part 2). Next, the transfer device 10 separates the first photoconductor 11 from the belt 16 as described below.

Figure 16:
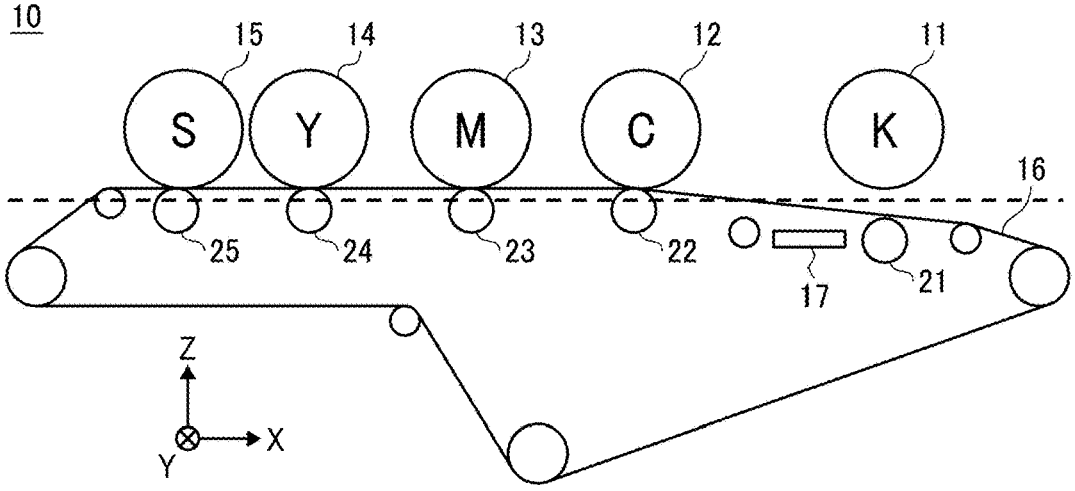
FIG. 16 is a diagram illustrating an example of the first sequence (part 3)

FIG. 16 is a diagram illustrating an example of the first sequence (part 3).

With the first sequence as illustrated in FIGS. 14 and 15, the transfer device 10 may shift the mode from the first printing state to the fifth printing state.

As illustrated in FIGS. 14 to 16, the transfer device 10 causes at least one of the five primary transfer rollers to press against the photoconductor, to shift the mode even in any state in the first sequence. In other words, the transfer device 10 shifts the mode to avoid the fully separated state illustrated in FIG. 3 in the first sequence.

Since the image forming system is turned off in the fully separated state, continuous printing is often stopped. As a result, if the first sequence includes the fully separated state, continuous printing may not be performed, resulting in a reduced productivity.

On the other hand, in a case where at least one of the five primary transfer rollers is pressed against the photoconductor to shift the mode, the productivity of the transfer device 10 may be enhanced.

In a case where the mode is shifted from the first printing state through the fifth printing state, the transfer device 10 may perform control in any one of a second sequence to a fifth sequence described below.

Example of Second Sequence

Figure 17:
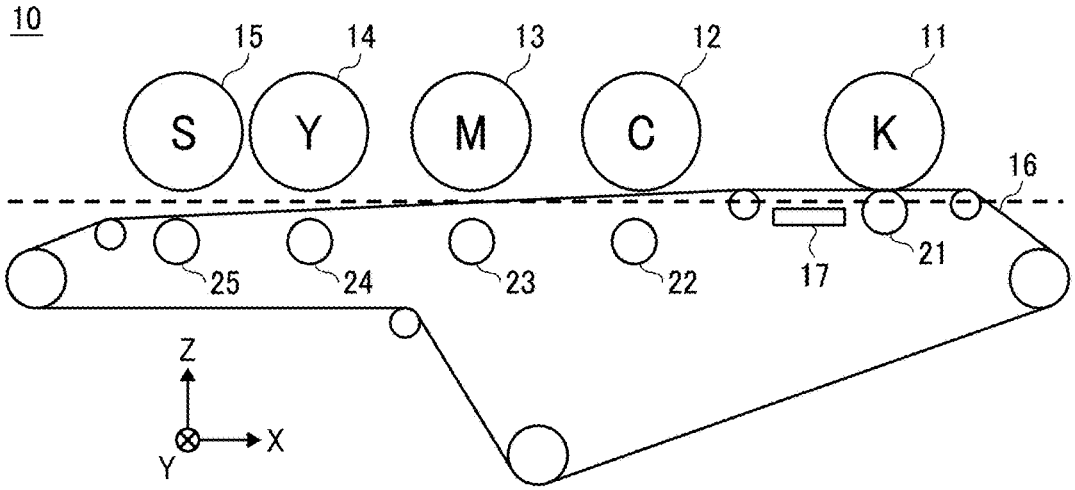
FIG. 17 is a diagram illustrating an example of a second sequence (part 1)

FIG. 17 is a diagram illustrating an example of the second sequence (part 1). First, the first printing state is a state as illustrated in FIG. 14. Next, the transfer device 10 brings the fifth photoconductor 15 into contact with the belt 16 as described below.

Figure 18:
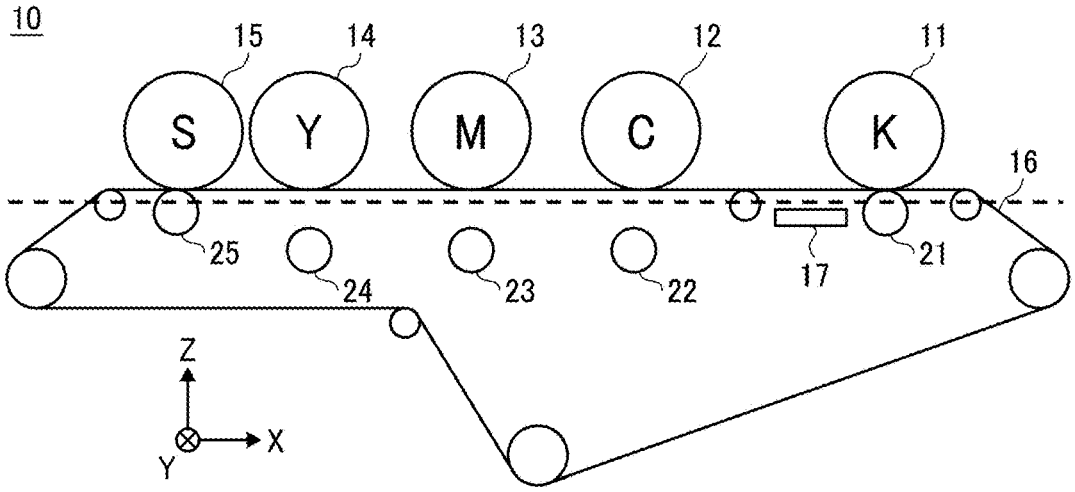
FIG. 18 is a diagram illustrating an example of the second sequence (part 2)

FIG. 18 is a diagram illustrating an example of the second sequence (part 2). Next, the transfer device 10 brings each of the second photoconductor 12 to the fourth photoconductor 14 into contact with the belt 16 as described below.

Figure 19:
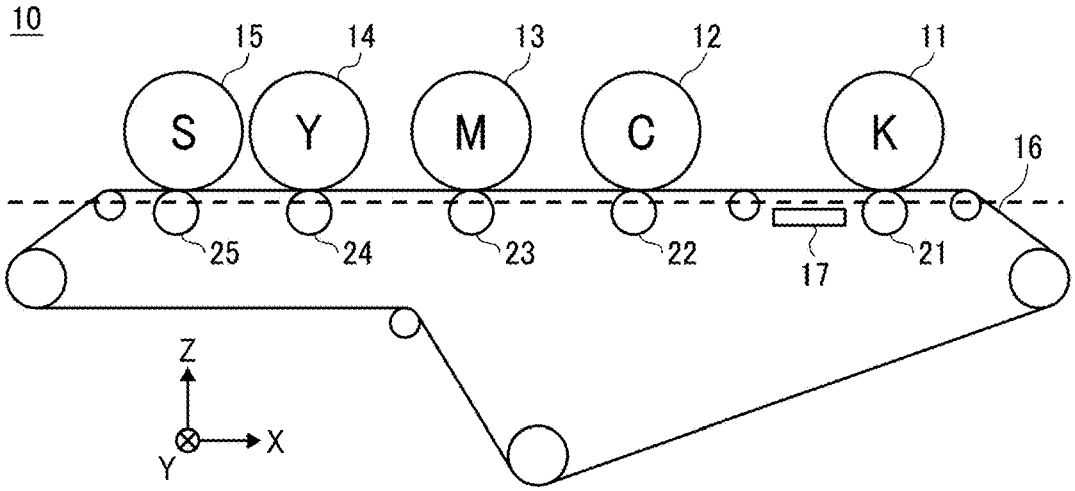
FIG. 19 is a diagram illustrating an example of the second sequence (part 3)

FIG. 19 is a diagram illustrating an example of the second sequence (part 3). Next, the transfer device 10 separates the first photoconductor 11 from the belt 16 as described below.

Figure 20:
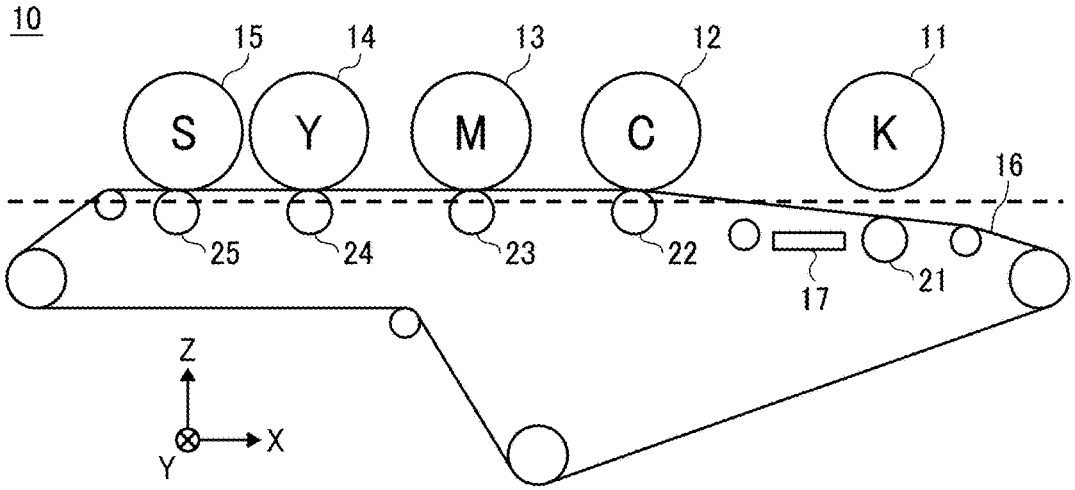
FIG. 20 is a diagram illustrating an example of the second sequence (part 4)

FIG. 20 is a diagram illustrating an example of the second sequence (part 4).

With the second sequence as illustrated in FIGS. 17, 18 and 19, the transfer device 10 may shift the mode from the first printing state to the fifth printing state.

As illustrated in FIGS. 17 to 20, the transfer device 10 causes at least one of the five primary transfer rollers to press against the photoconductor to shift the mode even in any state in the second sequence. In other words, the transfer device 10 shifts the mode to avoid the fully separated state illustrated in FIG. 3 in the second sequence.

When the mode is shifted by the second sequence, the productivity of the transfer device 10 may be enhanced.

Example of Third Sequence

Figure 21:
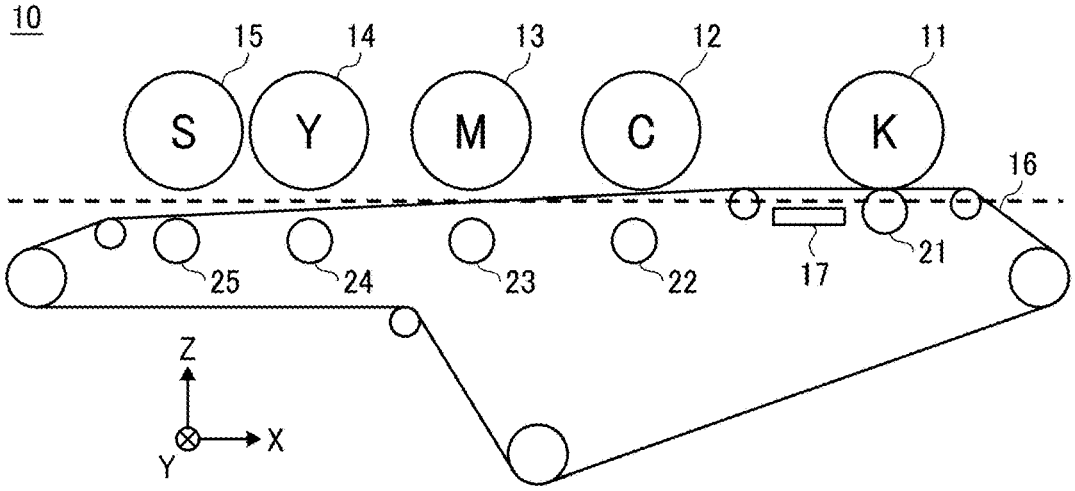
FIG. 21 is a diagram illustrating an example of a third sequence (part 1)

FIG. 21 is a diagram illustrating an example of a third sequence (part 1). First, the first printing state is a state as illustrated in FIG. 14. Next, the transfer device 10 brings each of the second photoconductor 12 to the fourth photoconductor 14 into contact with the belt 16 as described below.

Figure 22:
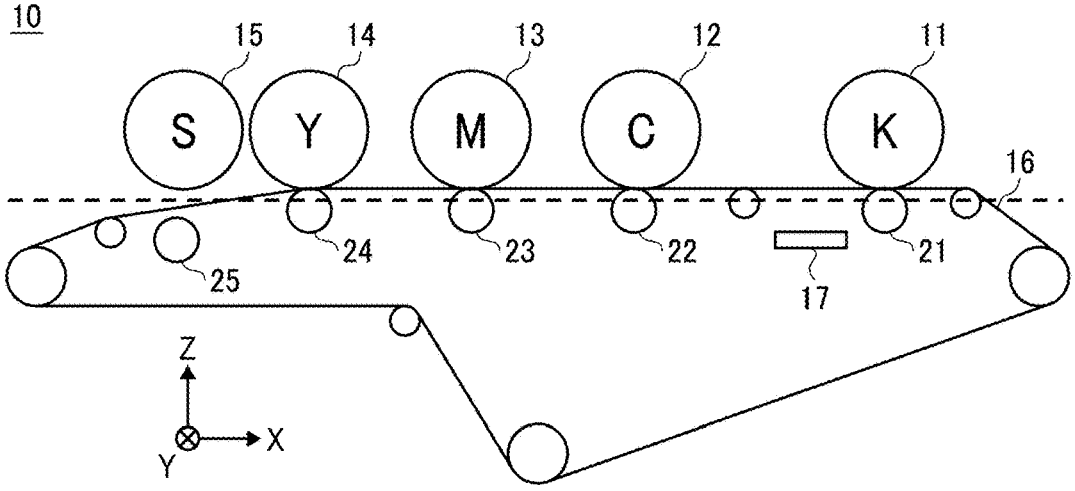
FIG. 22 is a diagram illustrating an example of the third sequence (part 2)

FIG. 22 is a diagram illustrating an example of the third sequence (part 2). Next, the transfer device 10 brings the fifth photoconductor 15 into contact with the belt 16 as described below.

Figure 23:
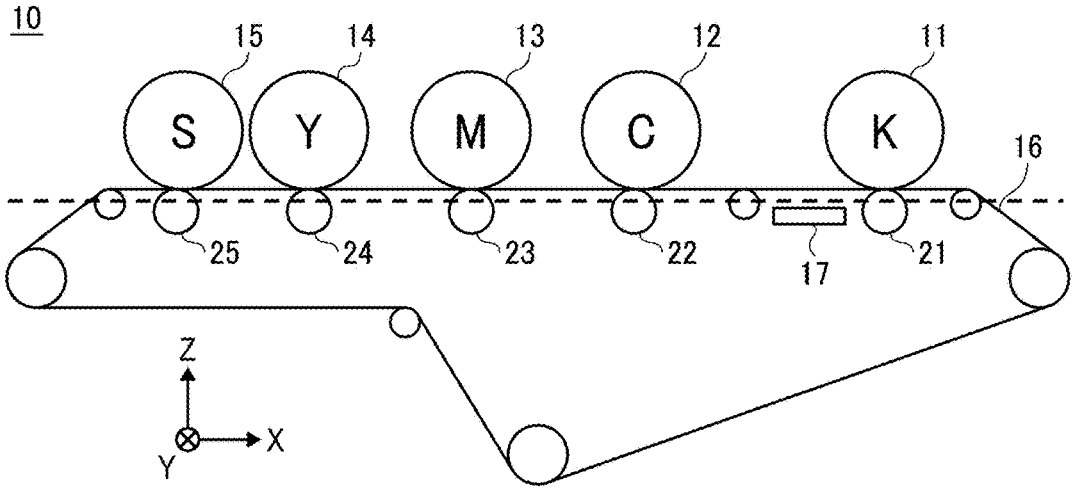
FIG. 23 is a diagram illustrating an example of the third sequence (part 3)

FIG. 23 is a diagram illustrating an example of the third sequence (part 3). Next, the transfer device 10 separates the first photoconductor 11 from the belt 16 as described below.

Figure 24:
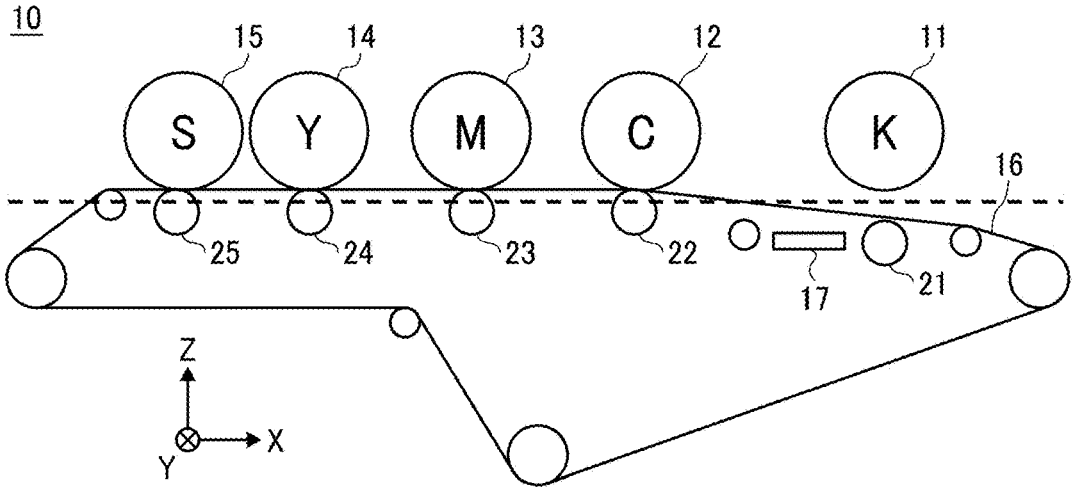
FIG. 24 is a diagram illustrating an example of the third sequence (part 4)

FIG. 24 is a diagram illustrating an example of the third sequence (part 4).

With the third sequence as illustrated in FIGS. 21, 22 and 23, the transfer device 10 may shift the mode from the first printing state to the fifth printing state.

As illustrated in FIGS. 21 to 24, the transfer device 10 causes at least one of the five primary transfer rollers to press against the photoconductor to shift the mode even in any state in the third sequence. In other words, the transfer device 10 shifts the mode to avoid the fully separated state illustrated in FIG. 3 in the third sequence.

When the mode is shifted by the third sequence, the productivity of the transfer device 10 may be enhanced.

Example of Fourth Sequence

Figure 25:
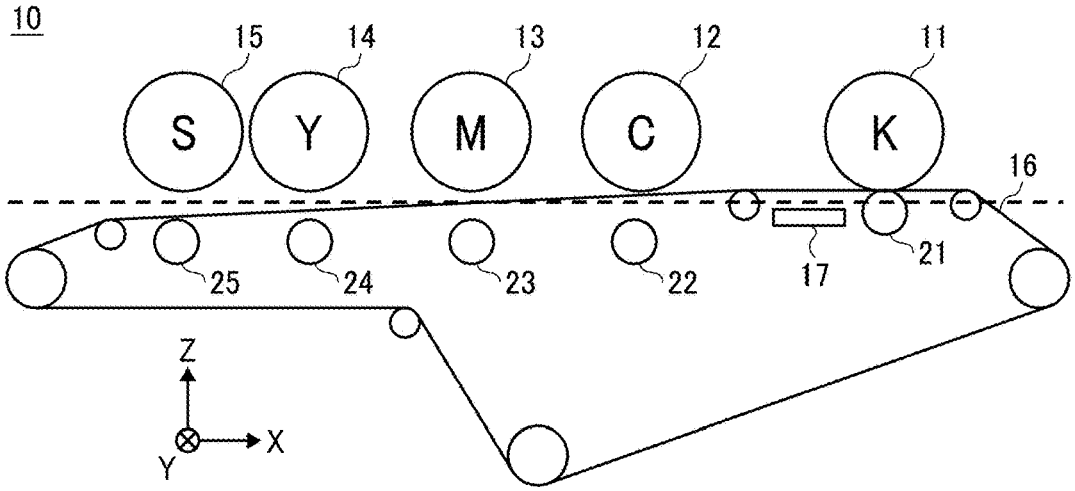
FIG. 25 is a diagram illustrating an example of a fourth sequence (part 1)

FIG. 25 is a diagram illustrating an example of a fourth sequence (part 1). First, the first printing state is a state as illustrated in FIG. 14. Next, the transfer device 10 brings the fifth photoconductor 15 into contact with the belt 16 as described below.

Figure 26:
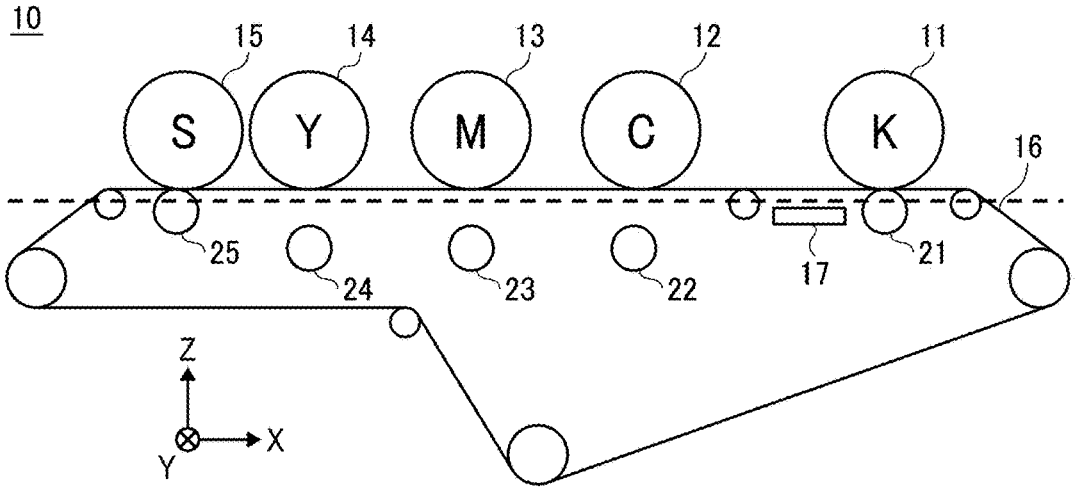
FIG. 26 is a diagram illustrating an example of the fourth sequence (part 2)

FIG. 26 is a diagram illustrating an example of the fourth sequence (part 2). Next, the transfer device 10 separates the first photoconductor 11 from the belt 16 as described below.

Figure 27:
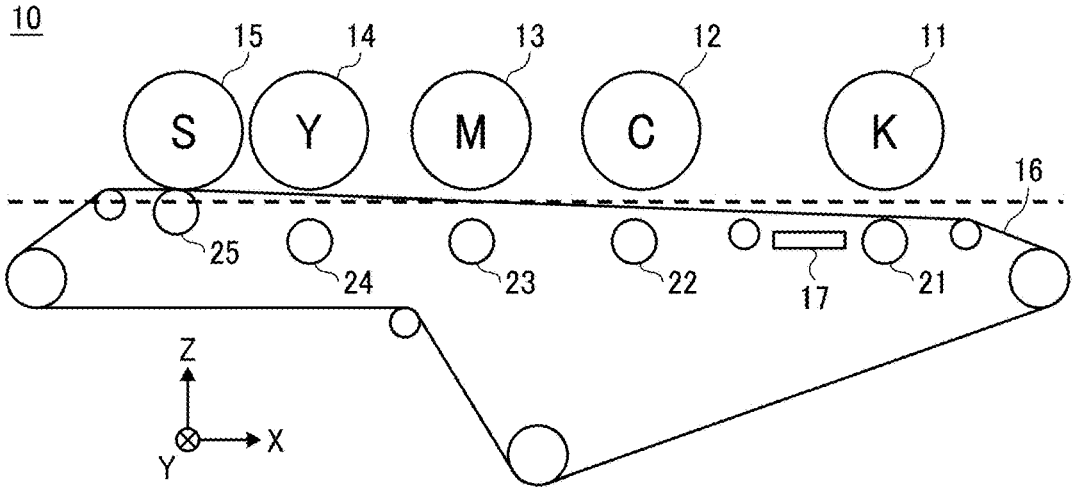
FIG. 27 is a diagram illustrating an example of the fourth sequence (part 3)

FIG. 27 is a diagram illustrating an example of the fourth sequence (part 3). Next, the transfer device 10 brings each of the second photoconductor 12 to the fourth photoconductor 14 into contact with the belt 16 as described below.

Figure 28:
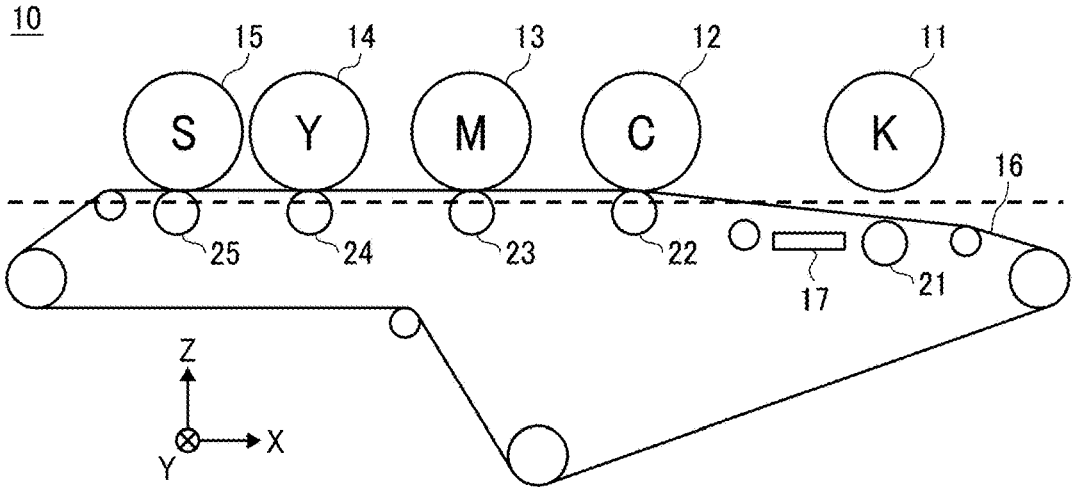
FIG. 28 is a diagram illustrating an example of the fourth sequence (part 4)

FIG. 28 is a diagram illustrating an example of the fourth sequence (part 4).

With the fourth sequence as illustrated in FIGS. 25, 26 and 27, the transfer device 10 may shift the mode from the first printing state to the fifth printing state.

As illustrated in FIGS. 25 to 28, the transfer device 10 causes at least one of the five primary transfer rollers to press against the photoconductor to shift the mode even in any state in the fourth sequence. In other words, the transfer device 10 shills the mode to avoid the fully separated state illustrated in FIG. 3 in the fourth sequence.

When the mode is shifted by the fourth sequence, the productivity of the transfer device 10 may be enhanced.

Example of Fifth Sequence

Figure 29:
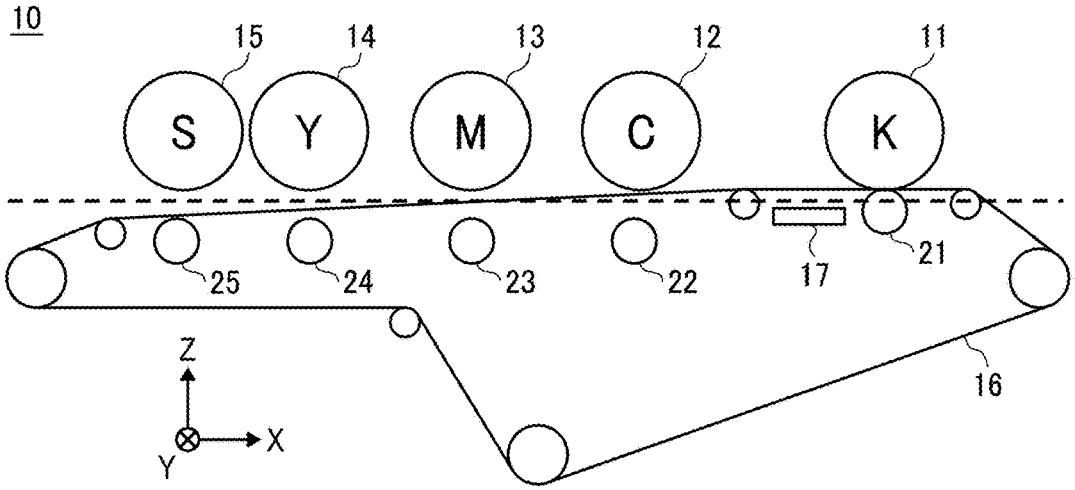
FIG. 29 is a diagram illustrating an example of a fifth sequence (part 1)

FIG. 29 is a diagram illustrating an example of the fifth sequence (part 1). First, the first printing state is a state as illustrated in FIG. 14. Next, the trans r device 10 brings each of the second photoconductor 12 to the fourth photoconductor 14 into contact with the belt 16 as described below.

Figure 30:
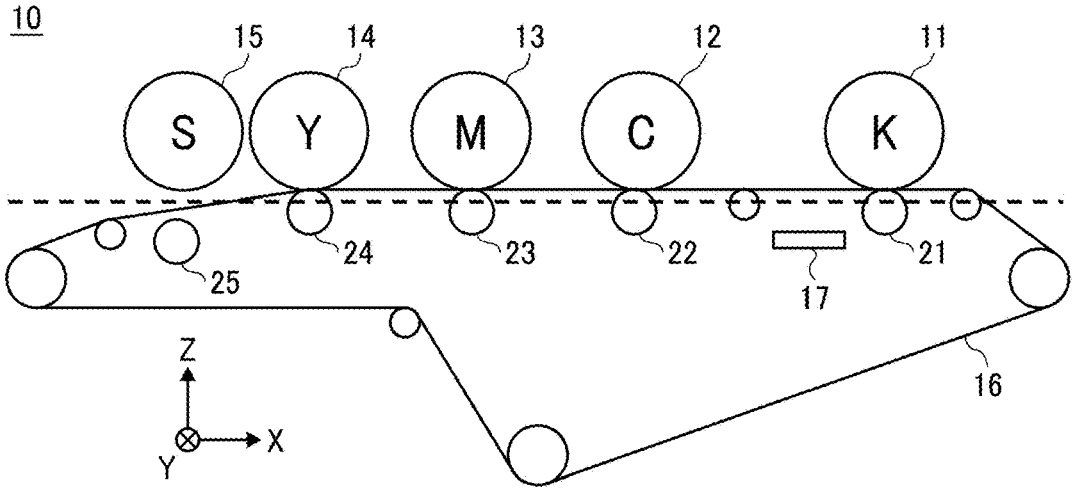
FIG. 30 is a diagram illustrating an example of the fifth sequence (part 2)

FIG. 30 is a diagram illustrating an example of the fifth sequence (part 2). Next, the transfer device 10 separates the first photoconductor 11 from the belt 16 as described below.

Figure 31:
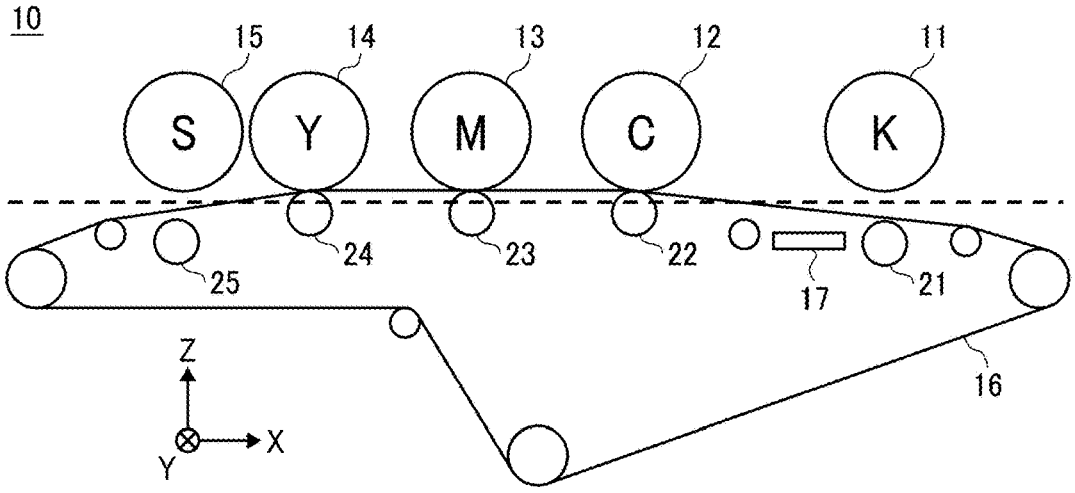
FIG. 31 is a diagram illustrating an example of the fifth sequence (part 3)

FIG. 31 is a diagram illustrating an example of the fifth sequence (part 3). Next, the transfer device 10 brings the fifth photoconductor 15 into contact with the belt 16 as described below.

Figure 32:
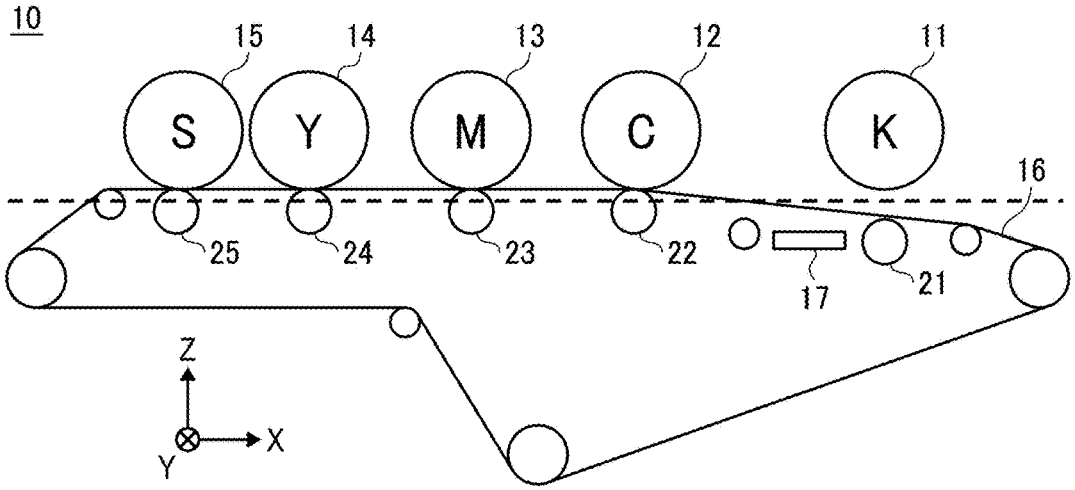
FIG. 32 is a diagram illustrating an example of the fifth sequence (part 4)

FIG. 32 is a diagram illustrating an example of the fifth sequence (part 4).

With the fifth sequence as illustrated in FIGS. 29, 30 and 31, the transfer device 10 may shift the mode from the first printing state to the filth priming state.

As illustrated in FIGS. 29 to 32, the transfer device 10 causes at least one of the five primary transfer rollers to press against the photoconductor to shift the mode even in any state in the fifth sequence. In other words, the transfer device 10 shifts the mode to avoid the fully separated state illustrated in FIG. 3 in the fifth sequence.

When the mode is shifted by the fifth sequence, the productivity of the transfer device 10 may be enhanced.

The mode shift is not limited to the shift from the first printing state to the fifth printing state. For example, the mode shift may be the shift from the fifth priming state to the first printing state. Specifically, the transfer device 10 may shift the mode with a sixth sequence to a ninth sequence as described below.

Example of Sixth Sequence

Figure 33:
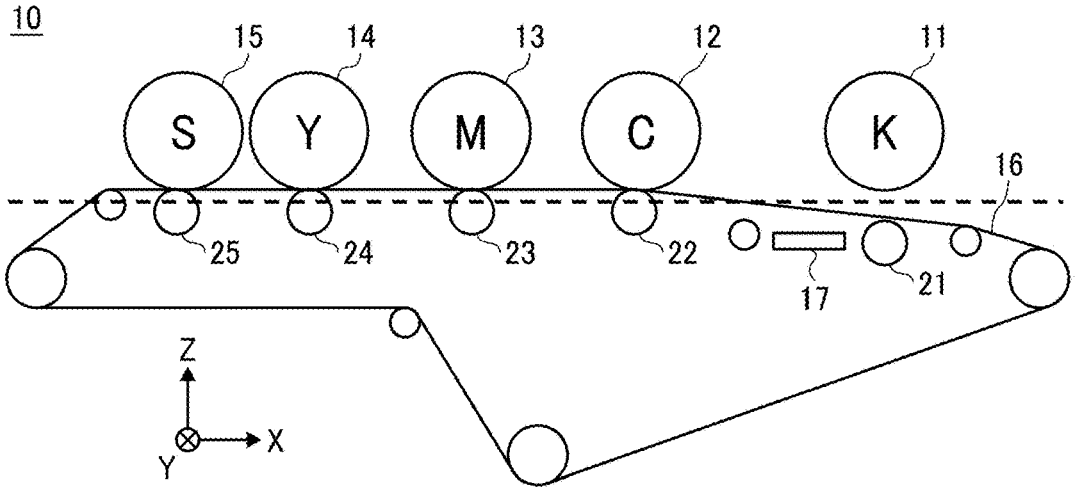
FIG. 33 is a diagram illustrating an example of a sixth sequence (part 1)

FIG. 33 is a diagram illustrating an example of the sixth sequence (part 1). First, the fifth printing state is a state as illustrated in FIG. 8. Next, the transfer device 10 brings the first photoconductor 11 into contact with the belt 16 as described below.

Figure 34:
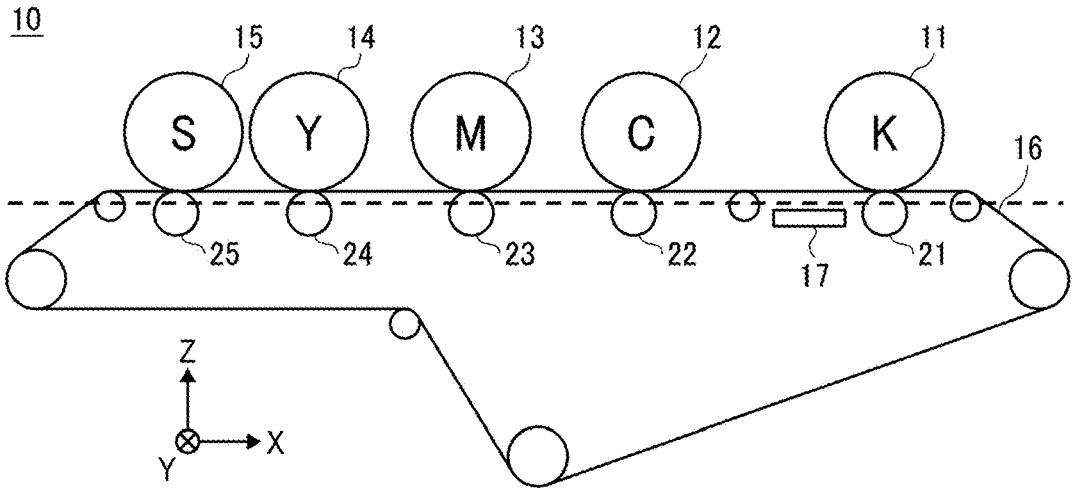
FIG. 34 is a diagram illustrating an example of the sixth sequence (part 2)

FIG. 34 is a diagram illustrating an example of the sixth sequence (part 2). Next, the transfer device 10 separates each of the second photoconductor 12 to the fourth photoconductor 14 from the belt 16 as described below.

Figure 35:
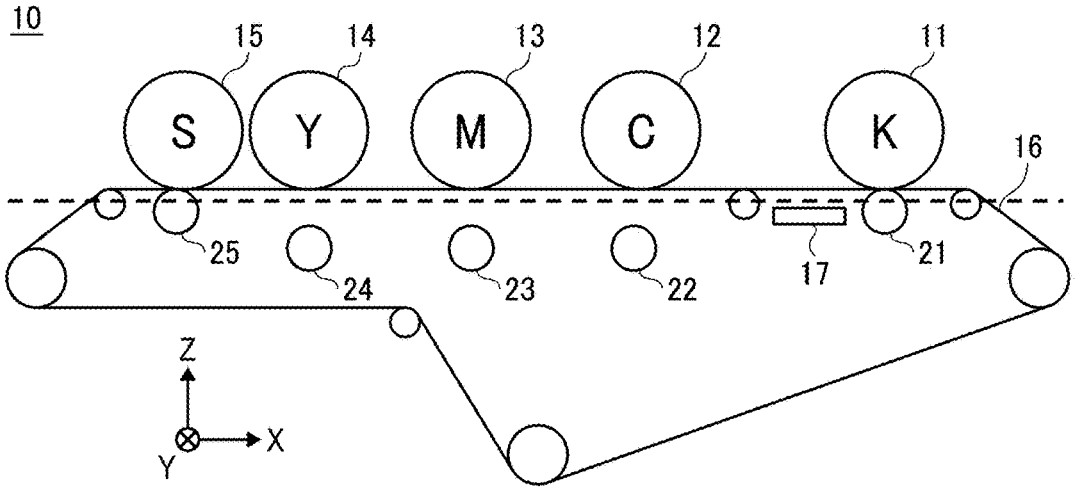
FIG. 35 is a diagram illustrating an example of the sixth sequence (part 3)

FIG. 35 is a diagram illustrating an example of the sixth sequence (part 3). Next, the transfer device 10 separates the fifth photoconductor 15 from the belt 16 as described below.

Figure 36:
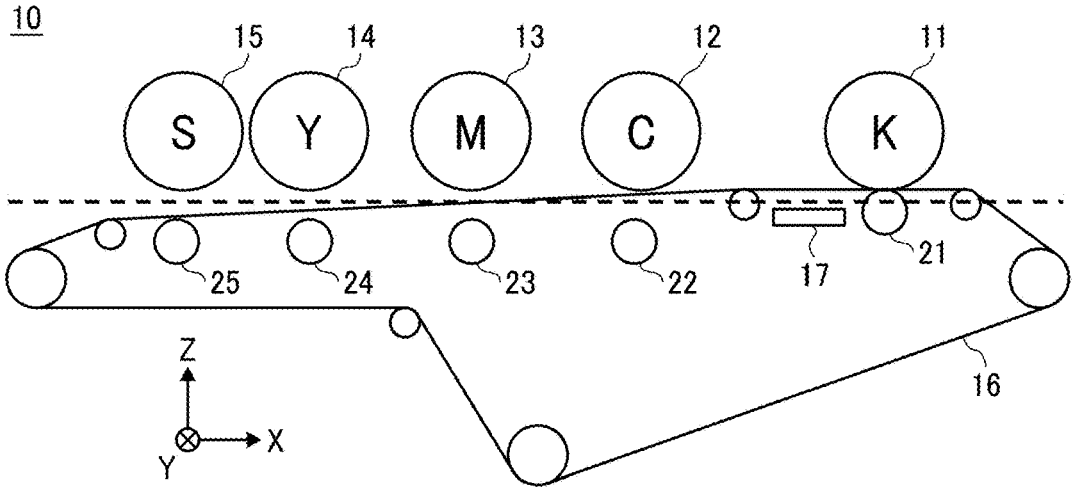
FIG. 36 is a diagram illustrating an example of the sixth sequence (part 4)

FIG. 36 is a diagram illustrating an example of the sixth sequence (part 4).

With the sixth sequence as illustrated in FIGS. 33, 34 and 35, the transfer device 10 may shift the mode from the fifth printing state to the first printing state.

As illustrated in FIGS. 33 to 36, the transfer device 10 causes at least one of the five primary transfer rollers to press against the photoconductor to shift the mode even in any state in the sixth sequence. In other words, the transfer device 10 shifts the mode to avoid the fully separated state illustrated in FIG. 3 in the sixth sequence.

When the mode is shifted by the sixth sequence, the productivity of the transfer device 10 may be enhanced.

Example of Seventh Sequence

Figure 37:
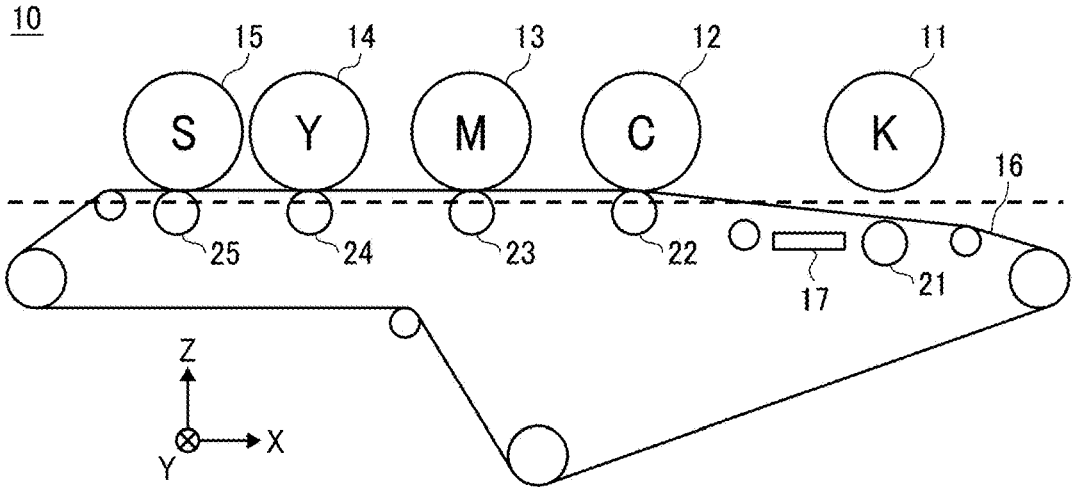
FIG. 37 is a diagram illustrating an example of a seventh sequence (part 1)

FIG. 37 is a diagram illustrating an example of a seventh sequence (part 1). First, the fifth printing state is a state as illustrated in FIG. 8. Next, the transfer device 10 brings the first photoconductor 11 into contact with the belt 16 as described below.

Figure 38:
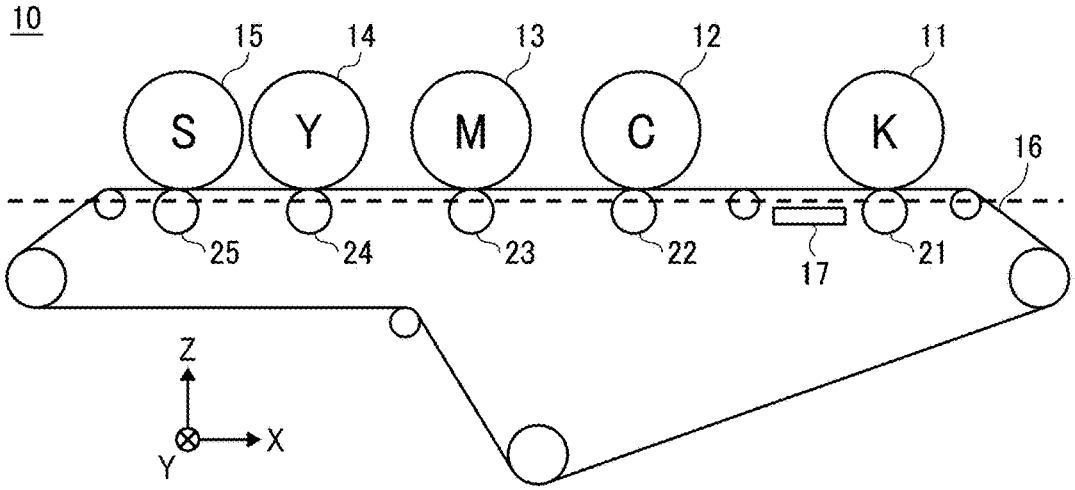
FIG. 38 is a diagram illustrating an example of the seventh sequence (part 2)

FIG. 38 is a diagram illustrating an example of the seventh sequence (part 2). Next, the transfer device 10 separates the fifth photoconductor 15 from the belt 16 as described below.

Figure 39:
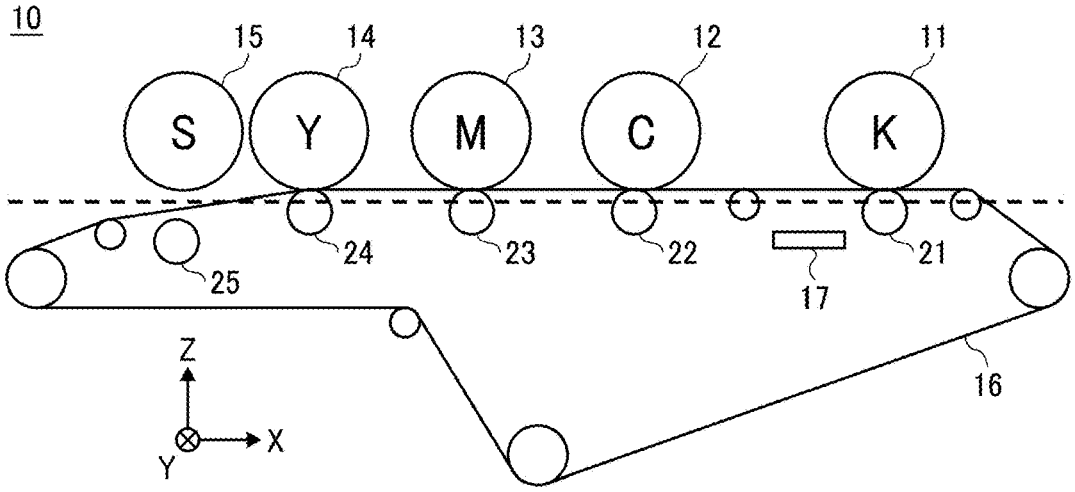
FIG. 39 is a diagram illustrating an example of the seventh sequence (part 3)

FIG. 39 is a diagram illustrating an example of the seventh sequence (part 3). Next, the transfer device 10 separates each of the second photoconductor 12 to the fourth photoconductor 14 from the belt 16 as described below.

Figure 40:
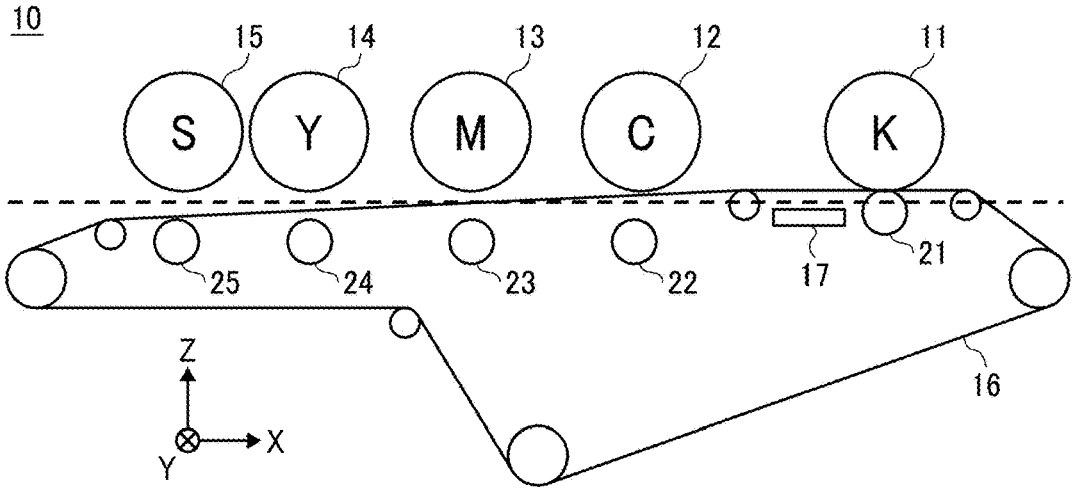
FIG. 40 is a diagram illustrating an example of the seventh sequence (part 4)

FIG. 40 is a diagram illustrating an example of the seventh sequence (part 4).

With the seventh sequence as illustrated in FIGS. 37, 38 and 39, the transfer device 10 may shift the mode from the fifth printing state to the first printing state.

As illustrated in FIGS. 37 to 40, the transfer device 10 causes at least one of the five primary transfer rollers to press against the photoconductor to shift the mode even in an state in the seventh sequence. In other words, the transfer device 10 shifts the mode to avoid the fully separated state illustrated in FIG. 3 in the seventh sequence.

When the mode is shifted by the seventh sequence, the productivity of the transfer device 10 may be enhanced.

Example of Eighth Sequence

Figure 41:
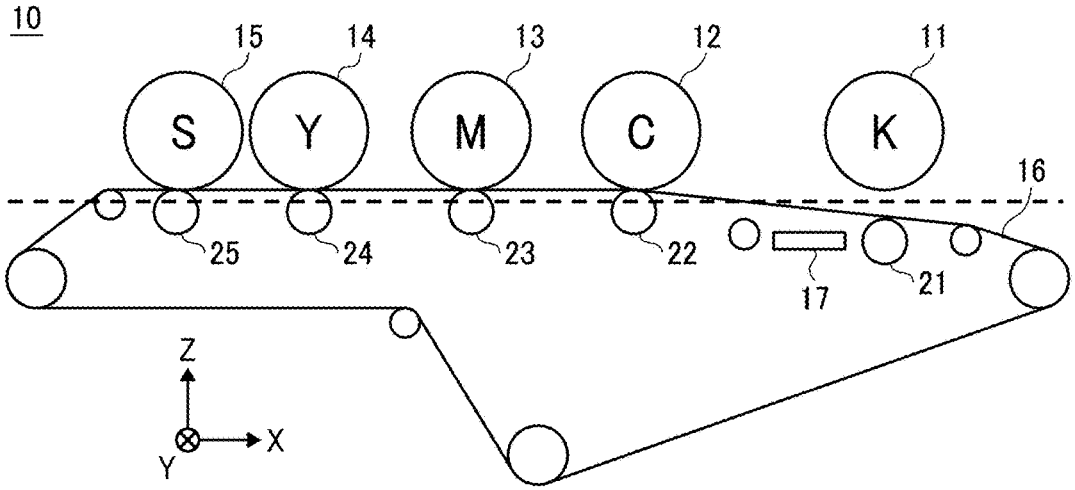
FIG. 41 is a diagram illustrating an example of an eighth sequence (part 1)

FIG. 41 is a diagram illustrating an example of an eighth sequence (part 1). First, the fifth printing state is a state as illustrated in FIG. 8. Next, the transfer device 10 separates each of the second photoconductor 12 to the fourth photoconductor 14 from the belt 16 as described below.

Figure 42:
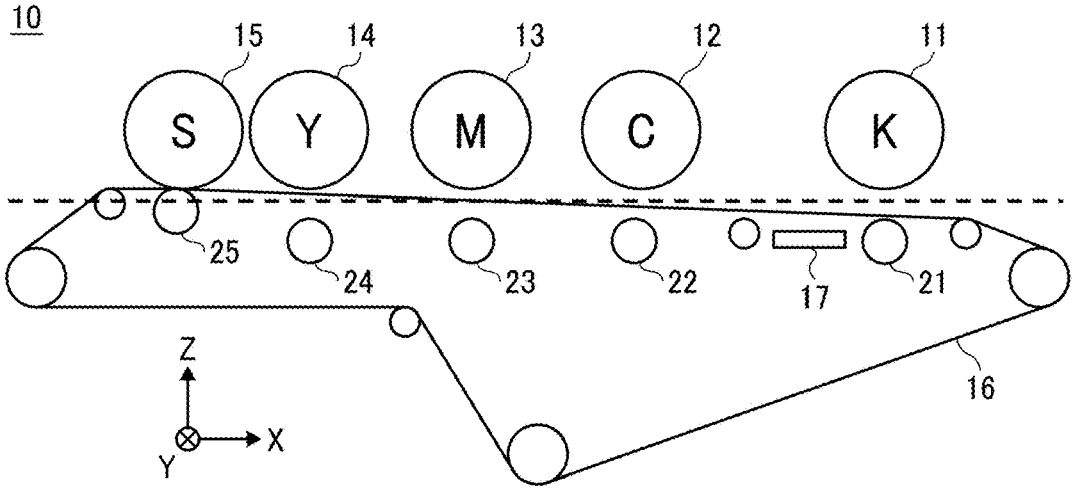
FIG. 42 is a diagram illustrating an example of the eighth sequence (part 2)

FIG. 42 is a diagram illustrating an example of the eighth sequence (part 2). Next, the to device 10 brings the first photoconductor 11 into contact with the belt 16 as described below.

Figure 43:
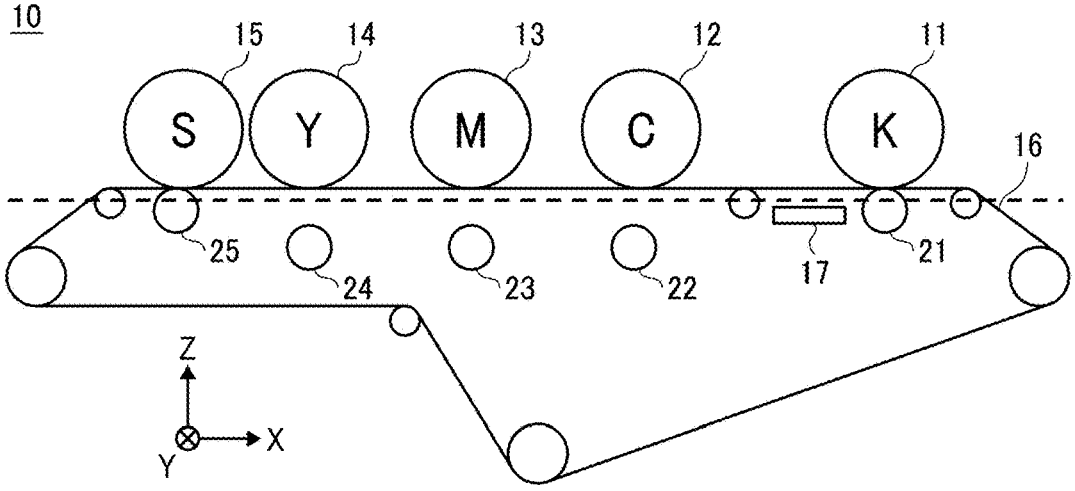
FIG. 43 is a diagram illustrating an example of the eighth sequence (part 3)

FIG. 43 is a diagram illustrating an example of the eighth sequence (part 3). Next, the transfer device 10 separates the fifth photoconductor 15 from the belt 16 as described below.

Figure 44:
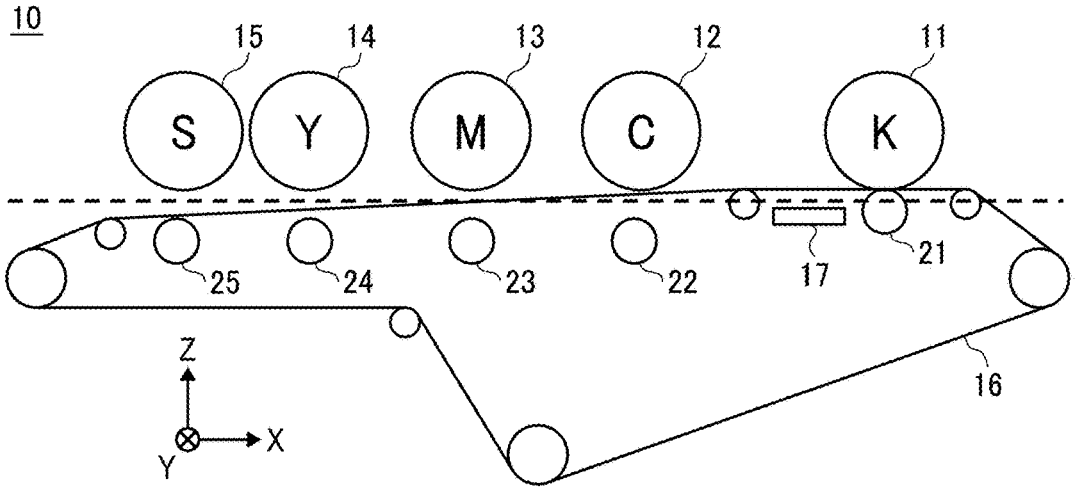
FIG. 44 is a diagram illustrating an example of the eighth sequence (part 4)

FIG. 44 is a diagram illustrating an example of the eighth sequence (part 4).

With the eighth sequence as illustrated in FIGS. 41, 42 and 43, the transfer device 10 may shift the mode from the fifth printing state to the first printing state.

As illustrated in FIGS. 41 to 44, the transfer device 10 causes at least one of the five primary transfer rollers to press against the photoconductor to shift the mode even in any state in the eighth sequence. In other words, the transfer device 10 shifts the mode to avoid the fully separated state illustrated in FIG. 3 in the eighth sequence.

When the mode is shifted by the eighth sequence, the productivity of the transfer device 10 may be enhanced.

Example of Ninth Sequence

Figure 45:
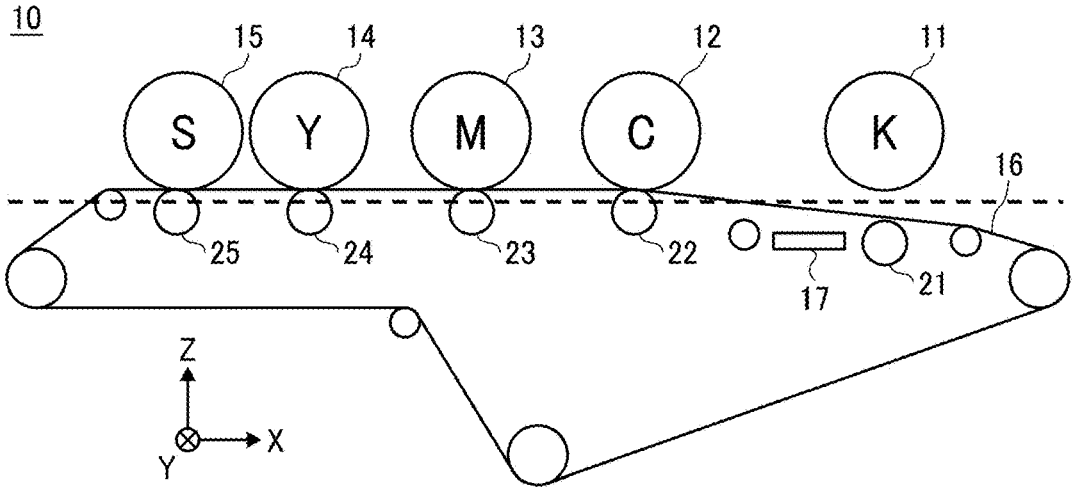
FIG. 45 is a diagram illustrating an example of a ninth sequence (part 1)

FIG. 45 is a diagram illustrating an example of the ninth sequence (part 1). First, the fifth printing state is a state as illustrated in FIG. 8. Next, the transfer device 10 separates the fifth photoconductor 15 from the belt 16 as described below.

Figure 46:
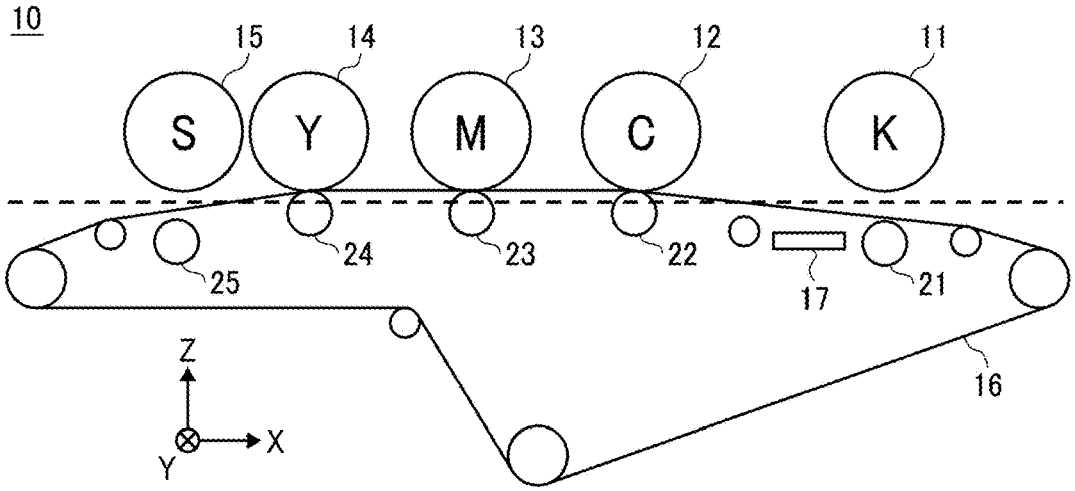
FIG. 46 is a diagram illustrating an example of the ninth sequence (part 2)

FIG. 46 is a diagram illustrating an example of the ninth sequence (part 2). Next, the transfer device 10 brings the first photoconductor 11 into contact with the belt 16 as described below.

Figure 47:
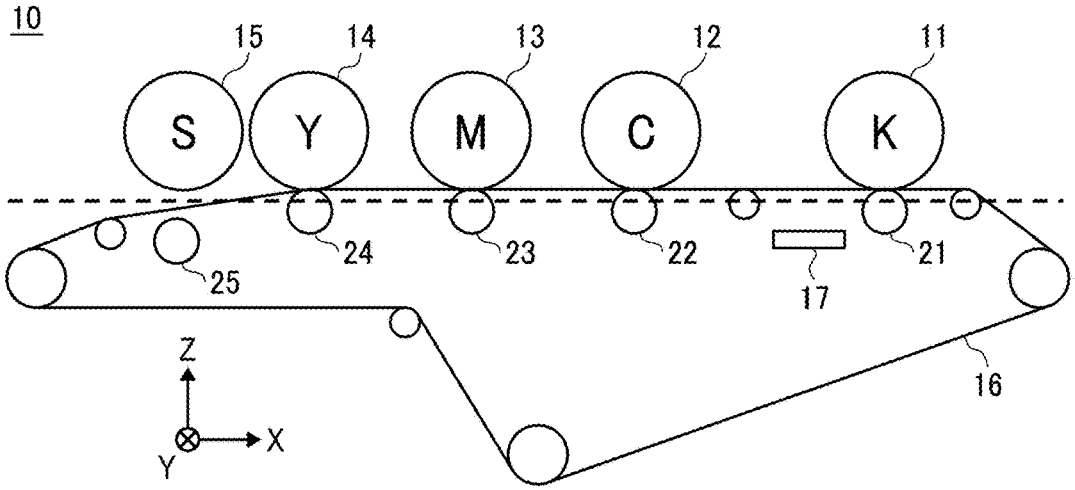
FIG. 47 is a diagram illustrating an example of the ninth sequence (part 3)

FIG. 47 is a diagram illustrating an example of the ninth sequence (part 3). Next, the transfer device 10 separates each of the second photoconductor 12 to the fourth photoconductor 14 from the belt 16 as described below.

Figure 48:
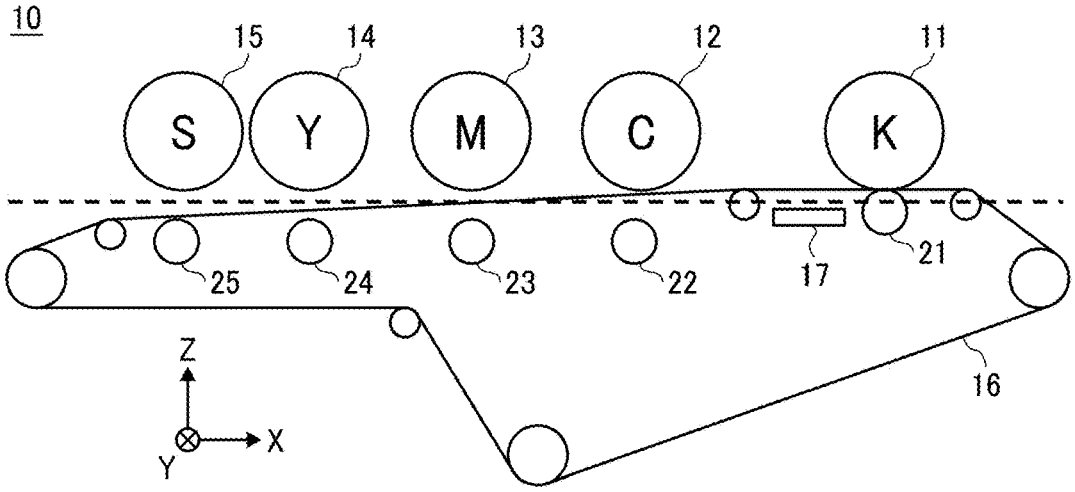
FIG. 48 is a diagram illustrating an example of the ninth sequence (part 4)

FIG. 48 is a diagram illustrating an example of the ninth sequence (part 4).

With the ninth sequence as illustrated in FIGS. 45, 46 and 47, the transfer device 10 may shift the mode from the fifth printing state to the first printing state.

As illustrated in FIGS. 45 to 48, the transfer device 10 causes at least one of the five primary transfer rollers to press against the photoconductor to shift the mode even in any state in the ninth sequence. In other words, the transfer device 10 shifts the mode to avoid the fully separated state illustrated in FIG. 3 in the ninth sequence.

When the mode is shifted by the ninth sequence, the productivity of the transfer device 10 may be enhanced.

Example of Tenth Sequence

Descriptions are given of an example of the shill from a mode for priming with the first photoconductor 11 to a mode for printing with the fifth photoconductor 15. In other words, while the mode is shifted from the first printing state to the fourth printing state, the primary transfer roller is controlled so as to perform a tenth sequence as described below.

Figure 49:
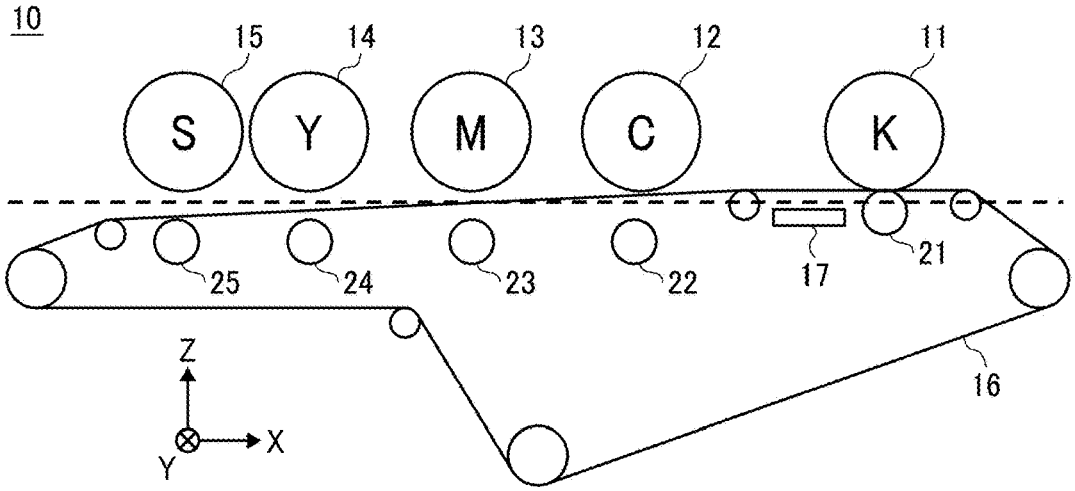
FIG. 49 is a diagram illustrating an example of a tenth sequence (part 1)

FIG. 49 is a diagram illustrating an example of the tenth sequence (part 1). First, the first printing state is a state as illustrated in FIG. 4. Next, the transfer device 10 brings the fifth photoconductor 15 into contact with the belt 16 as described below.

Figure 50:
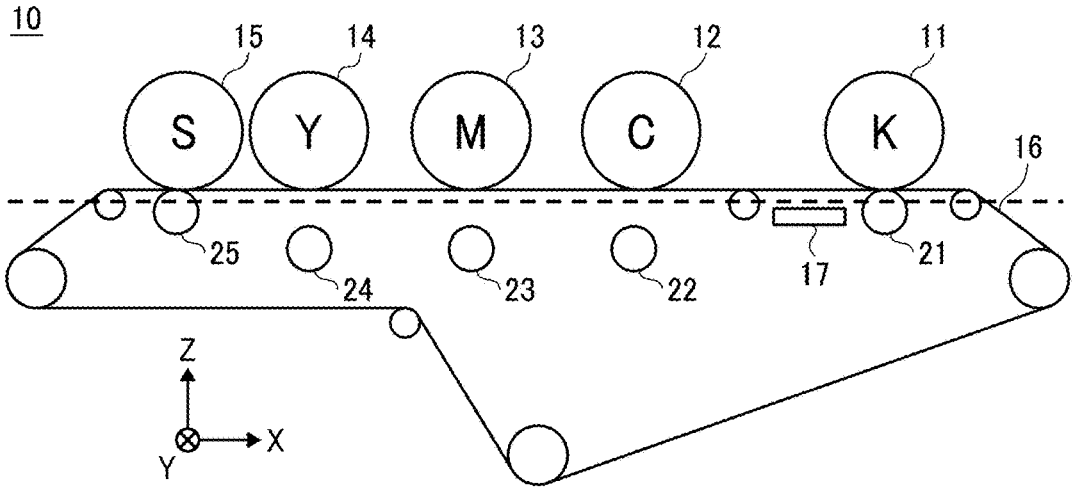
FIG. 50 is a diagram illustrating an example of the tenth sequence (part 2)

FIG. 50 is a diagram illustrating an example of the tenth sequence (part 2). Next, the transfer device 10 separates the first photoconductor 11 from the belt 16 as described below.

Figure 51:
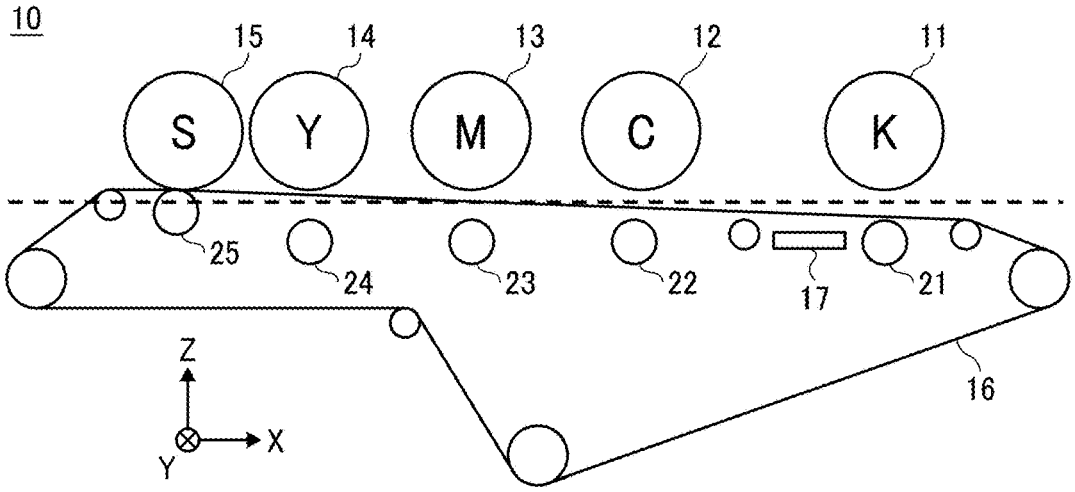
FIG. 51 is a diagram illustrating an example of the tenth sequence (part 3)

FIG. 51 is a diagram illustrating an example of the tenth sequence (part 3).

With the tenth sequence as illustrated in FIGS. 49 and 50, the transfer device 10 may shill the mode from the first printing state to the fourth printing state.

As illustrated in FIGS. 49 to 51, the transfer device 10 causes at least one of the five primary transfer rollers to press against the photoconductor to shift the mode even in any state in the tenth sequence. In other words, the transfer device 10 shifts the mode to avoid the fully separated state illustrated in FIG. 3 in the tenth sequence.

When the mode is shifted by the tenth sequence, the productivity of the transfer device 10 may be enhanced.

Example of Eleventh Sequence

Descriptions are given of an example of the shift from a mode for printing with the fifth photoconductor 15 to a mode for printing with the first photoconductor 11. In other words, while the mode is shifted from the fourth printing state to the first printing state, the primary transfer roller is controlled so as to perform an eleventh sequence as described below.

Figure 52:
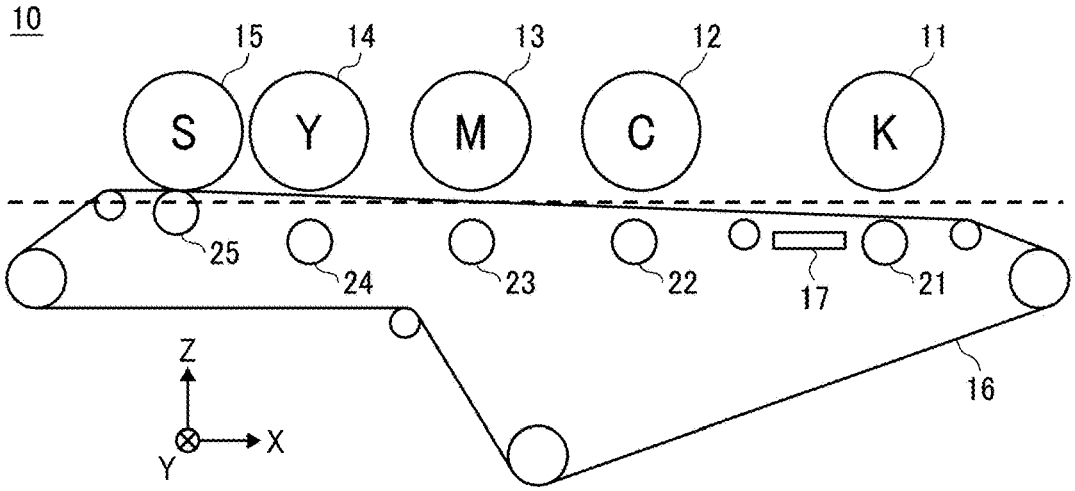
FIG. 52 is a diagram illustrating an example of an eleventh sequence (part 1)

FIG. 52 is a diagram illustrating an example of the eleventh sequence (part 1). First, the fourth printing state is a state as illustrated in FIG. 7. Next, the transfer device 10 brings the first photoconductor 11 into contact with the belt 16 as described below.

Figure 53:
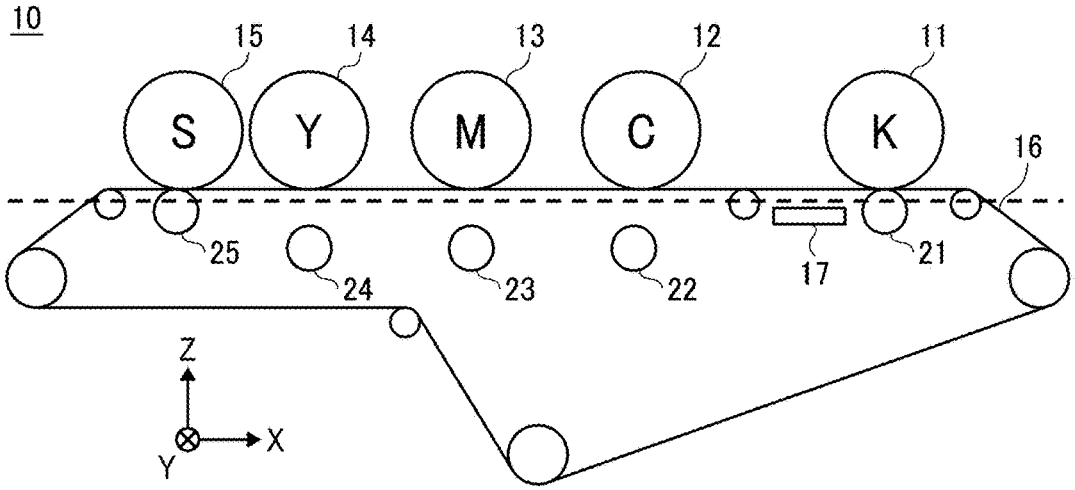
FIG. 53 is a diagram illustrating an example of the eleventh sequence (part 2)

FIG. 53 is a diagram illustrating an example of the eleventh sequence (part 2). Next, the transfer device 10 separates the fifth photoconductor 15 from the belt 16 as described below.

Figure 54:
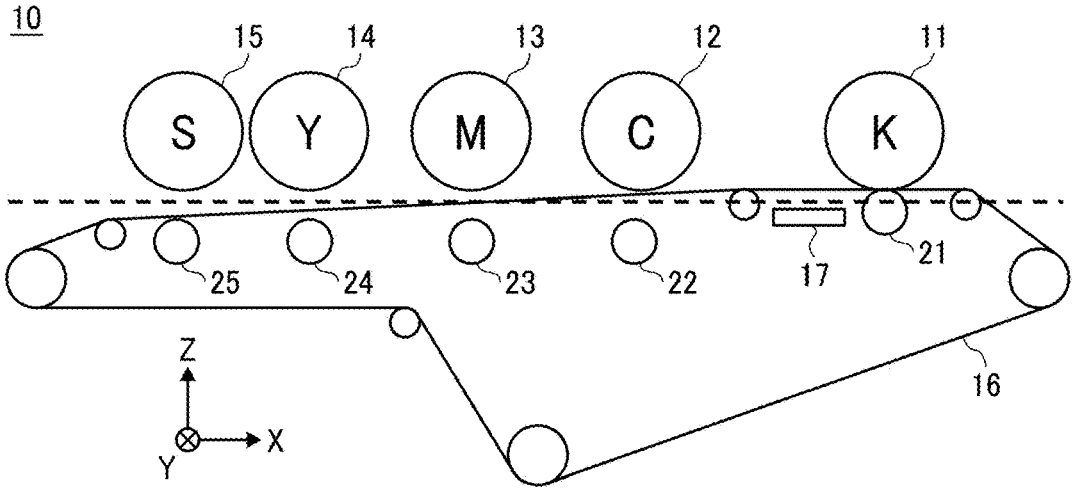
FIG. 54 is a diagram illustrating an example of the eleventh sequence (part 3)

FIG. 54 is a diagram illustrating an example of the eleventh sequence (part 3).

With the eleventh sequence as illustrated in FIGS. 52 and 53, the transfer device 10 may shift the mode from the fourth printing state to the first printing state.

As illustrated in FIGS. 52 to 54, the transfer device 10 causes at least one of the five primary transfer rollers to press against the photoconductor to shift the mode even in any state in the eleventh sequence. In other words, the transfer device 10 shifts the mode to avoid the fully separated state illustrated in FIG. 3 in the eleventh sequence.

When the mode is shifted by the eleventh sequence, the productivity of the transfer device 10 may be enhanced.

Control Sample

Descriptions are given of a sequence of a control sample where the mode is shifted from the first printing state to the fifth printing state.

Figure 55:
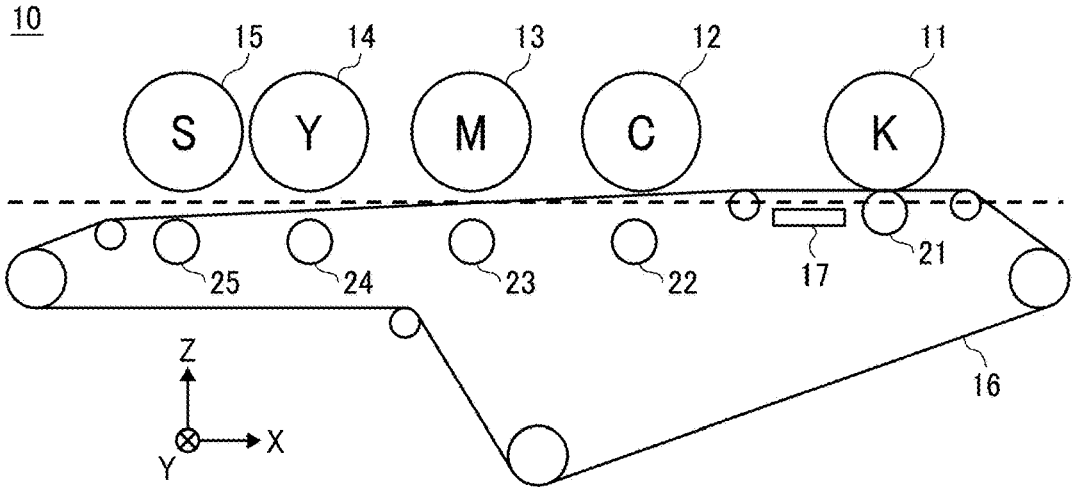
FIG. 55 is a diagram illustrating a sequence (part 1) of a control sample.

FIG. 55 is a diagram illustrating a sequence (part 1) of the control sample. First, the first printing state is a state as illustrated in FIG. 4. Next, the transfer device 10 separates the first photoconductor 11 from the belt 16. As a result, each of the photoconductors is separated, as described below.

Figure 56:
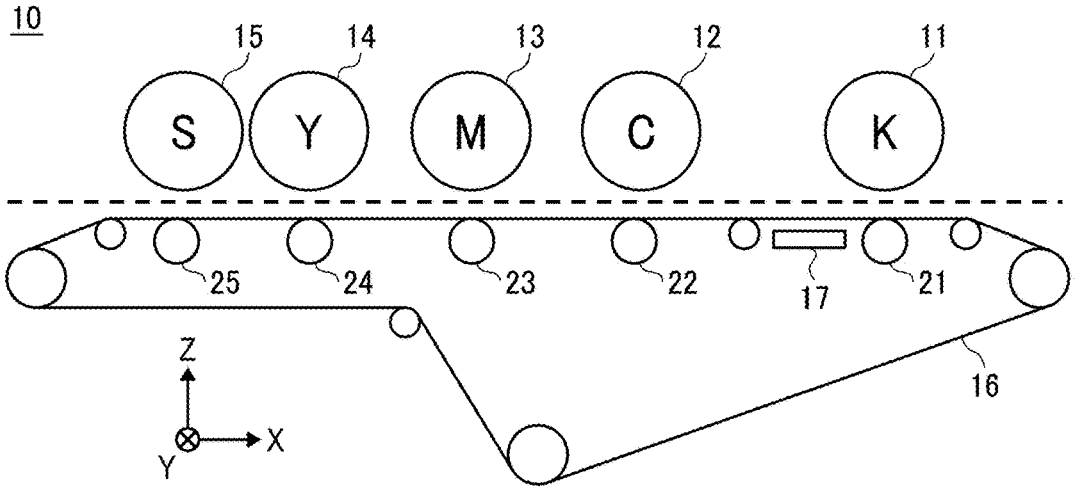
FIG. 56 is a diagram illustrating a sequence (part 2) of the control sample.

FIG. 56 is a diagram illustrating the sequence (part 2) of the control sample. As illustrated in FIG. 56, the transfer device 10 turns off the image forming system in the fully separated state, it is difficult to perform a printing in this state.

After the image forming system is started up, the transfer device 10 brings each of the second photoconductor 12 to the fifth photoconductor 15 into contact with the belt 16 as described below.

Figure 57:
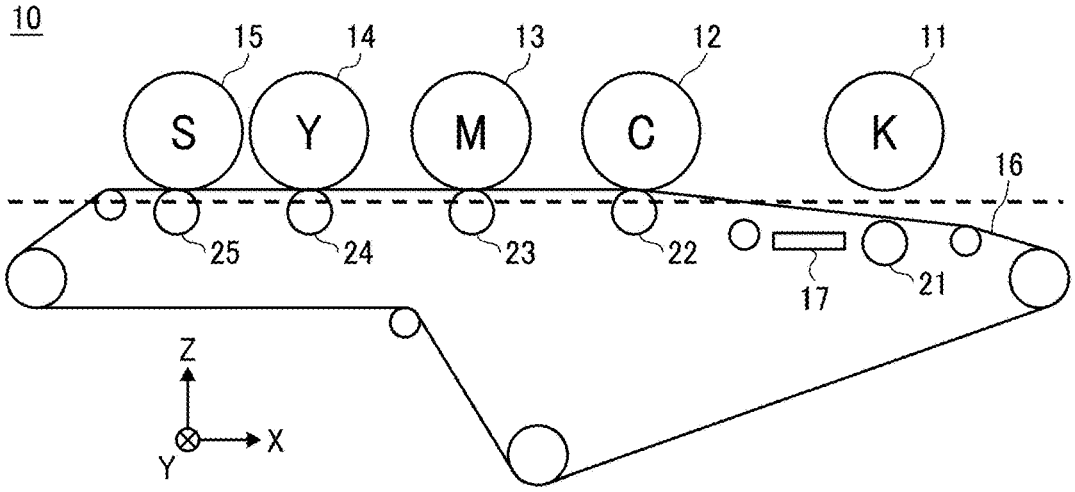
FIG. 57 is a diagram illustrating a sequence (part 3) of the control sample.

FIG. 57 is a diagram illustrating the sequence (part 3) of the control sample.

If the fully separated state illustrated in FIG. 3 occurs in the sequence illustrated in FIGS. 55 to 57, the transfer device 10 is likely to reduce the productivity due to the turning off of the image forming system.

Control Example

Figure 58:
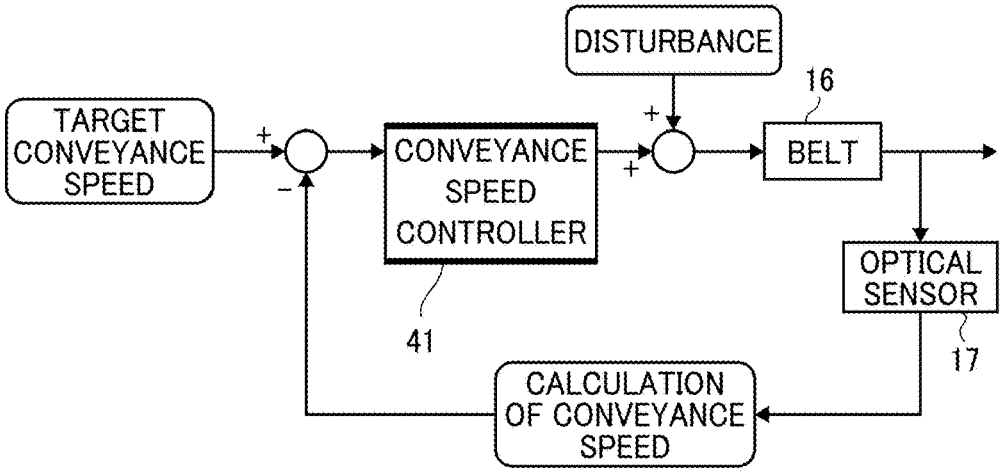
FIG. 58 is a diagram illustrating a control example based on a conveyance speed.

FIG. 58 is a diagram illustrating a control example based on the conveyance speed. For example, as illustrated in FIG. 58, it is preferable that the transfer device 10 is configured to perform feedback control of the conveyance speed.

Specifically, the transfer device 10 causes the optical sensor 17 to detect the marks 40 provided on the belt 16. Next, the transfer device 10 calculates a speed at which the belt 16 is conveyed, i.e., the conveyance speed of the belt 16, based on the detection result. Then, the calculation result is fed back and a conveyance speed controller 41 controls the conveyance speed to bring the conveyance speed closer to a target conveyance speed. Due to such a configuration, the transfer device 10 controls the conveyance speed to maintain a constant speed.

Further, it is preferable that the transfer device 10 controls the conveyance speed in real time. The constant conveyance speed can reduce color shift or positional deviation. As a result, a high-quality image may be formed.

Installation Example of Optical Sensor

Figure 59:
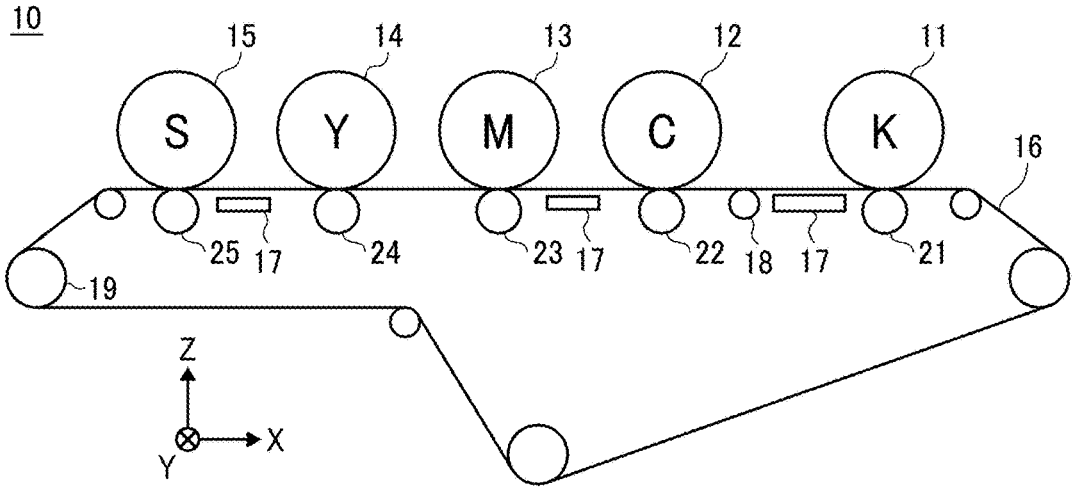
FIG. 59 is a diagram illustrating an installation example of optical sensors.

FIG. 59 is a diagram illustrating an installation example of the optical sensors. Optical sensors 17 may be installed, for example, at respective positions as illustrated in FIG. 59. A plurality of optical sensors 17 may be installed.

It is preferable that each of the optical sensors 17 is installed near the primary transfer roller or a support that supports the belt 16. Specifically, it is preferable that each of the optical sensors 17 is installed at a position within 10 centimeters (cm) from the primary transfer, roller or the support that supports the belt 16.

Due to the above-described configuration, in a case where the optical sensor 17 is installed near the primary transfer roller or the support that supports the belt 16, erroneous detection of the marks 40 due to fluctuation caused by the belt 16 may be reduced.

Example of Configuration for Changing Distance

Figure 60:
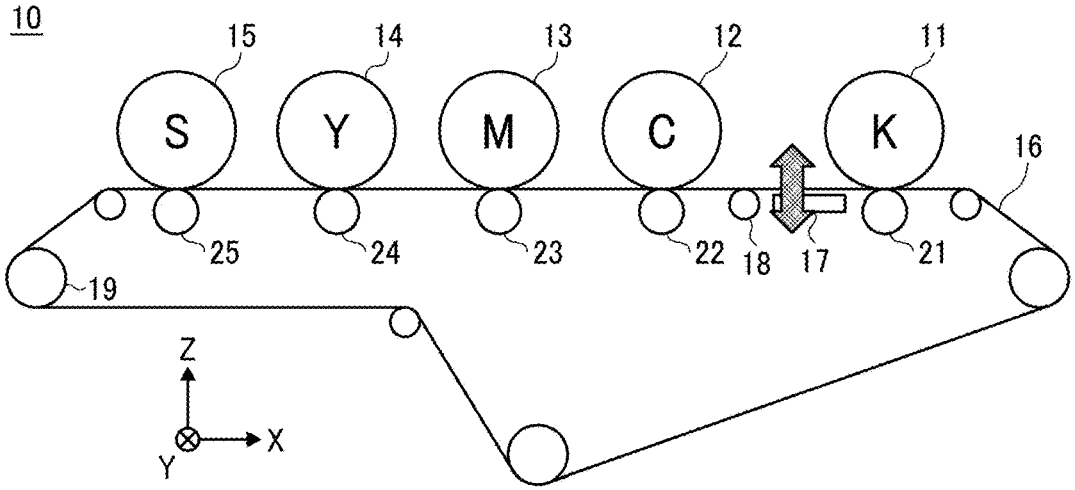
FIG. 60 is a diagram illustrating an example of a configuration of changing the distance between the optical sensor and the belt.

FIG. 60 is a diagram illustrating an example of a configuration of changing the distance between the optical sensor 17 and the belt 16. It is preferable that the transfer device 10 is configured to change the distance between the optical sensor 17 and the belt 16. Specifically, it is preferable that the transfer device 10 includes an actuator that moves the optical sensor 17 in the Z-axis direction in FIG. 60.

The distance between the optical sensor 17 and the belt 16 is changed by switching between contact and separation of the photoconductors and the belt 16 by the primary transfer rollers. Due to this configuration, it is preferable that the transfer device 10 is configured to adjust the distance between the optical sensor 17 and the belt 16 to an appropriate distance. Note that the appropriate distance is, for example, a distance at which the optical sensor 17 is in focus. Therefore, the appropriate distance is determined by optical condition of each optical sensor 17.

Example of Control by Rotational Speed

Figure 61:
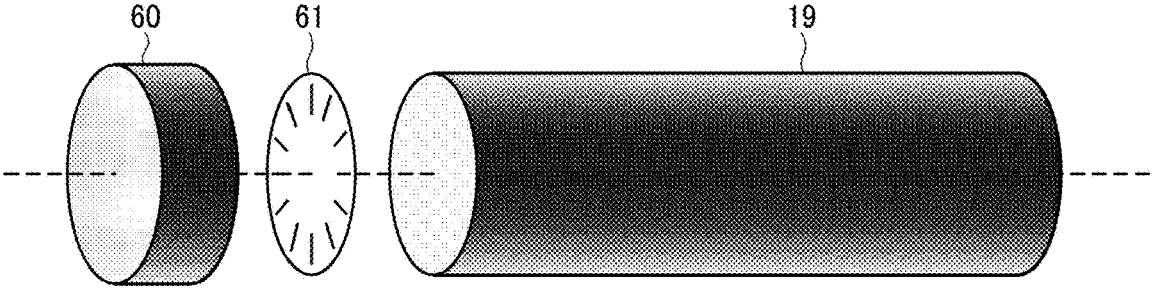
FIG. 61 is a diagram illustrating an example of a mechanism of measuring the rotational speed.

FIG. 61 is a diagram illustrating an example of a mechanism of measuring the rotational speed. The belt 16 rotates as a driving motor 60 serving as a driving source rotates the driving roller 19. For example, an encoder 61 is disposed on the shaft of the driving roller 19. Based on the rotational speed measured in this manner, for example, the control may be performed as described below.

Figure 62:
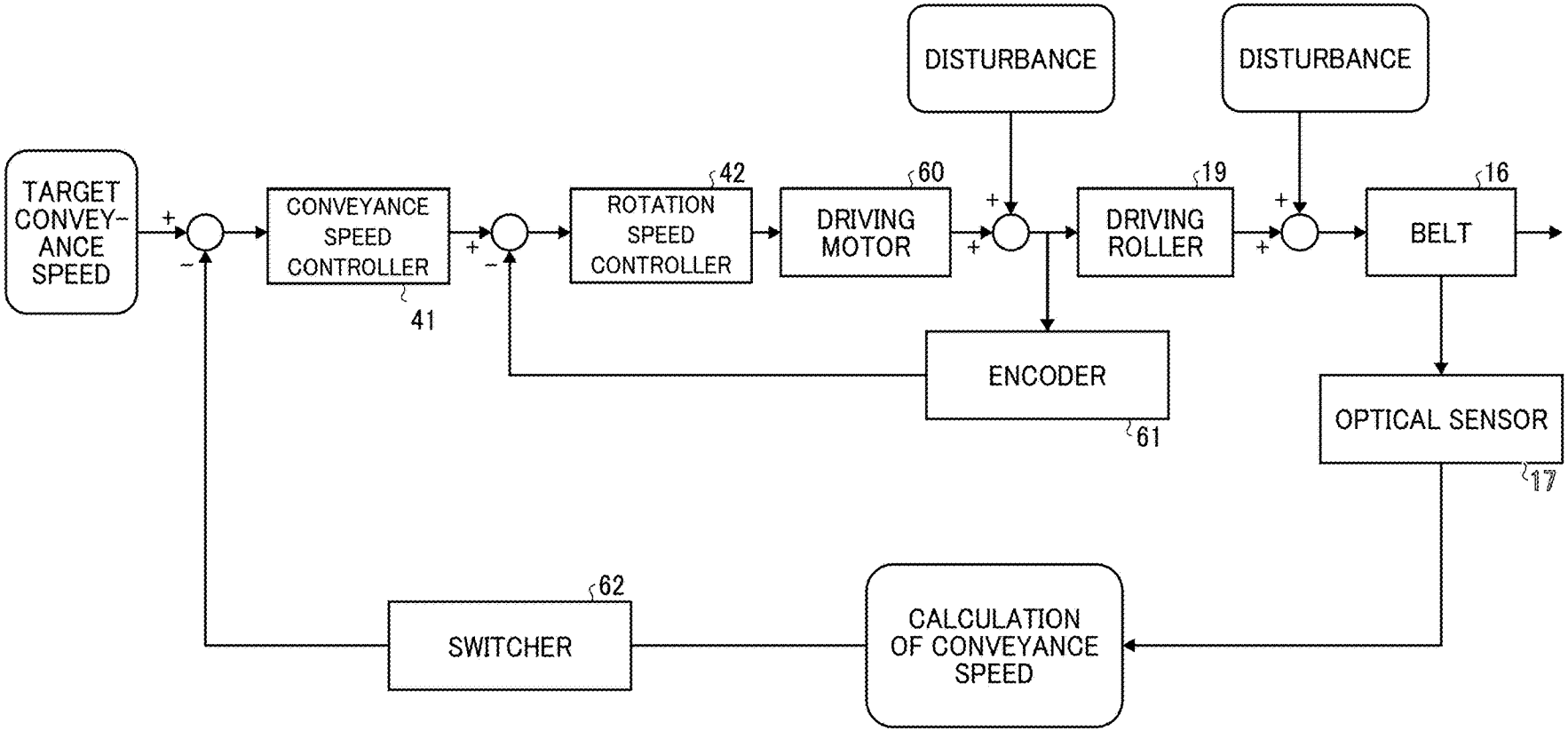
FIG. 62 is a diagram illustrating an example of control based on the rotational speed.

FIG. 62 is a diagram illustrating an example of the control based on the rotational speed of the driving roller 19. As illustrated in FIG. 62, providing the encoder 61 on the shaft of the driving roller 19 allows measurement of the rotational speed of the driving roller 19. When the measurement result by the encoder 61 is fed back, a rotation speed controller 42 performs the control based on the rotational speed of the driving roller 19.

The rotation speed controller 42 may further perform the control based an a differential system of the rotational speed of the driving roller 19.

Further, as illustrated in FIG. 62, the transfer device 10 may provide feedback on both the conveyance speed of the belt 16 and the rotational speed of the driving roller 19 using the conveyance speed controller 41 and the rotation speed controller 42. Providing feedback on both the conveyance speed of the belt 16 and the rotational speed of the driving roller 19 allows highly accurate control.

Note that the transfer device 10 may further include a switcher 62. For example, when the switcher 62 sets the output to zero (0), the transfer device 10 switches to provide the feedback on the rotational speed of the driving roller 19 without providing, the feedback on the conveyance speed of the belt 16. The switching of the feedback is performed, for example, by the process described below.

Example of Switching

Figure 63:
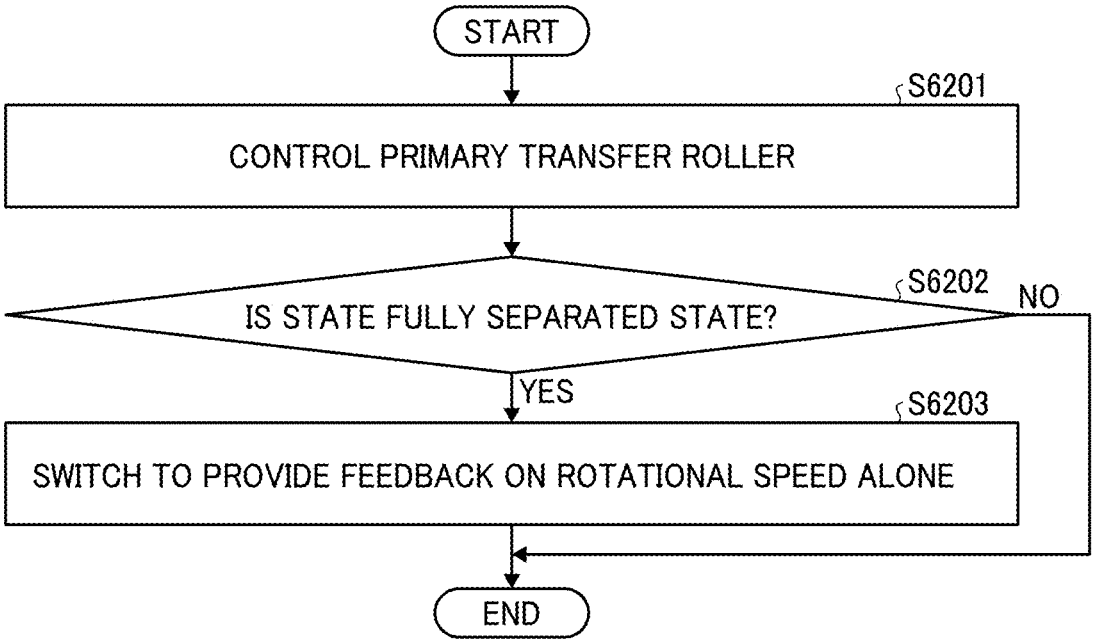
FIG. 63 is a flowchart of a first example of switching feedback.

FIG. 63 is a flowchart of a first example of switching feedback.

The transfer device 10 controls the primary transfer roller (step S6201). Specifically, the transfer device 10 controls the plurality of primary transfer rollers so that the primary transfer rollers are separated from the belt 16 or are brought into contact with the belt 16 in accordance with the mode.

The transfer device 10 determines whether the state is the fully separated state (step S6202). Next, when the transfer device 10 determines that the state is the fully separated state (YES in step S6202), the transfer device 10 proceeds to step S6203. When the transfer device 10 determines that the state is not the fully separated state (NO in step S6202), the transfer device 10 ends the process.

The transfer device 10 switches to provide the feedback on the rotational speed alone (step S6203).

For example, it is difficult to detect the marks 40 in the fully separated state. In such a case, the transfer device 10 controls by providing the feedback on the rotational speed without providing the feedback on the conveyance speed of the belt 16.

Due to the above-described configuration, the control based on the result of erroneous detection is prevented, and the transfer device 10 may perform control based on the rotational speed. By so doing, the transfer device 10 may prevent quality deterioration in in formation.

Figure 64:
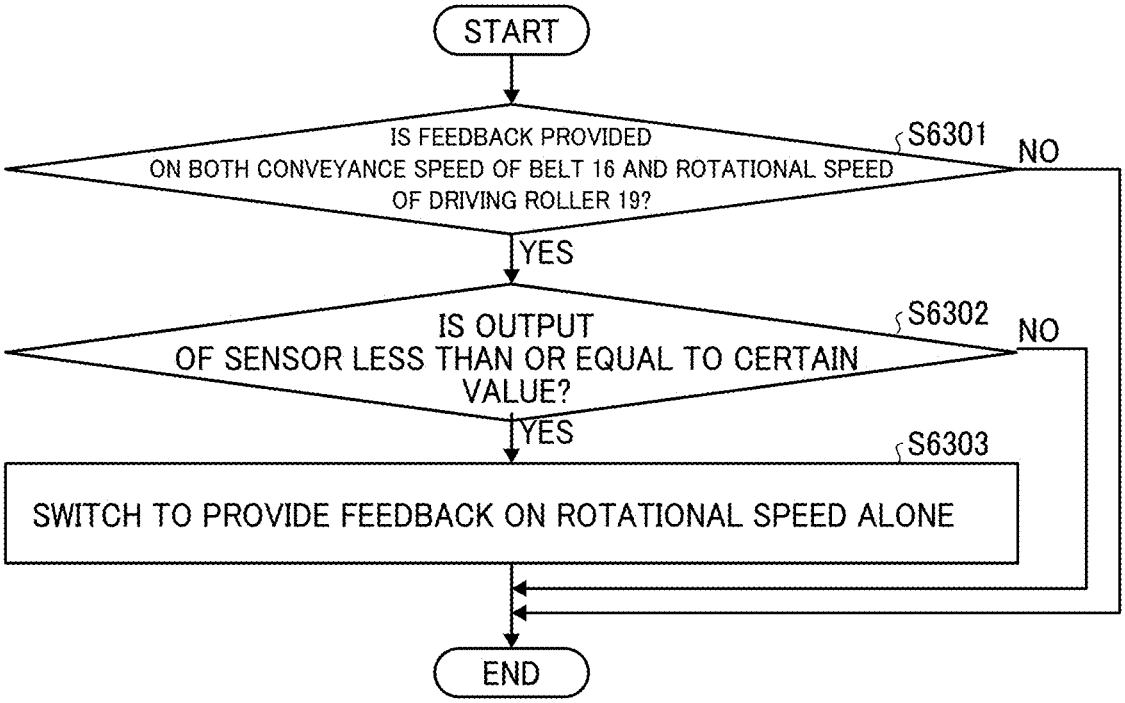
FIG. 64 is a flowchart of a second example of switching feedback.

FIG. 64 is a flowchart of a second example of switching feedback.

The transfer device 10 determines whether the feedback is provided on both the conveyance speed of the belt 16 and the rotational speed of the driving roller 19 (step S6301). Next, when the transfer device 10 determines that the feedback is provided on both the conveyance speed of the belt 16 and the rotational speed of the driving roller 19 (YES in step S6301), the transfer device 10 proceeds to step S6302. When the transfer device 10 determines that the feedback is not provided on both the conveyance speed of the belt 16 and the rotational speed of the driving roller 19 (NO in step S6301), the transfer device 10 ends the process.

The transfer device 10 determines whether the output of the sensor is less than or equal to a certain value (step S6302). Next, when the transfer device 10 determines that the output of the sensor is less than or equal to the certain value (YES in step S6302), the transfer device 10 proceeds to step S6303. When the transfer device 10 determines that the output of the sensor is greater than the certain value (NO in step S6302), the transfer device 10 ends the process.

For example, the output of the optical sensor 17 decreases if a scattering of toner or a failure occurs. In other words, in a case where the output of the sensor is relatively weak, the transfer device 10 determines that the scattering of toner or the failure occurs.

Note that the certain value serving as a criterion for determination i.e., the threshold is set in advance.

The transfer device 10 switches to provide the feedback on the rotational speed alone (step S6303).

When the output of the sensor is decreased, it is difficult to detect the mark 40 due to occurrence of the scattering of toner or the failure. In such a case, erroneous detection of the marks 40 is likely to occur. To address this inconvenience, the feedback based on the detection result by the optical sensor 17 is stopped. Due to the above-described configuration, the control based on the result of erroneous detection is prevented, and the transfer device 10 may perform control based on the rotational speed of the driving roller 19. As a result, the transfer device 10 may prevent quality deterioration in image formation.

Example of Functional Configuration

Figure 65:
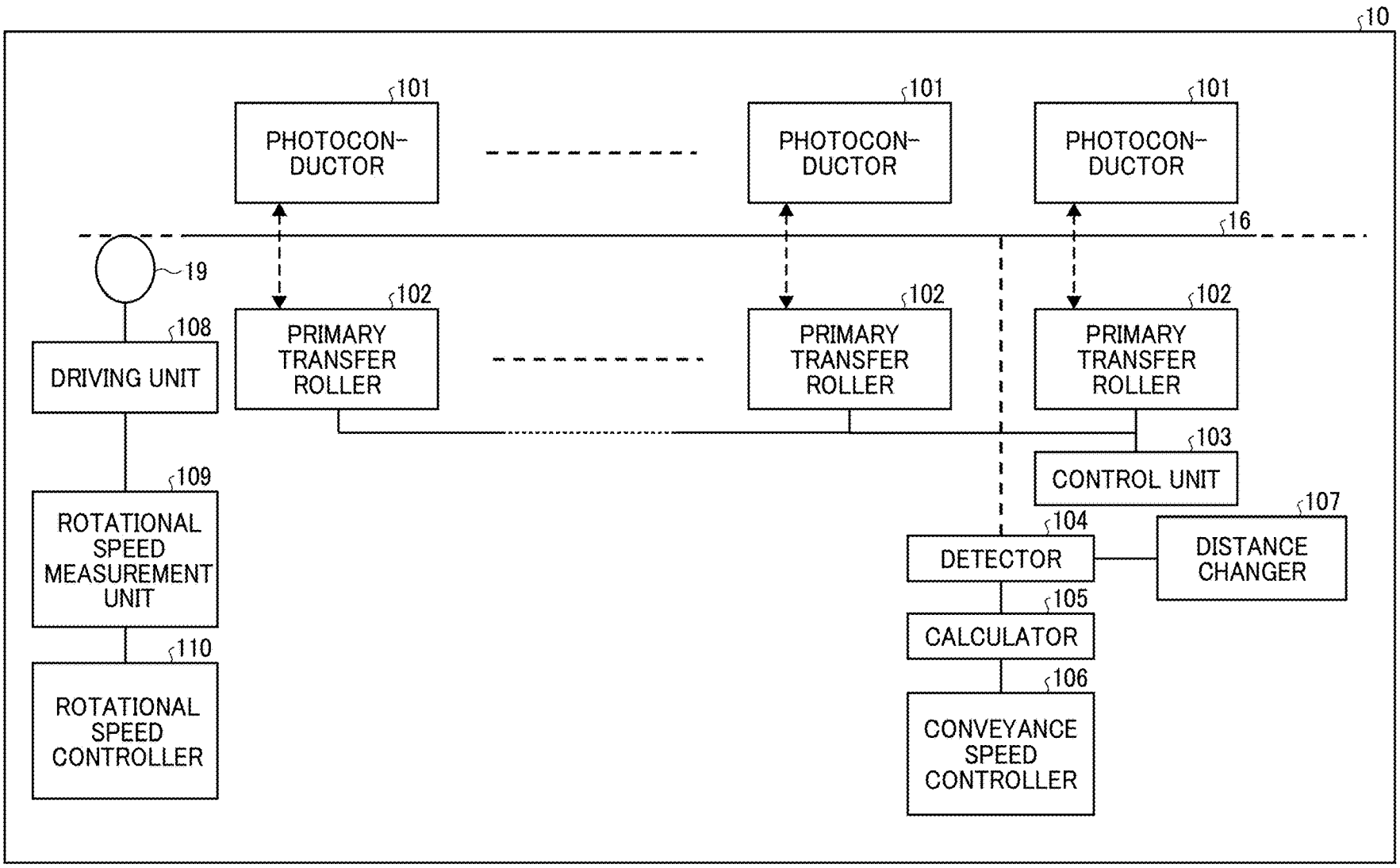
FIG. 65 is a diagram illustrating a functional configuration of the image forming apparatus, according to an embodiment of the present disclosure.

FIG. 65 is a diagram illustrating an example of a functional configuration of the transfer device 10. For example, the transfer device 10 includes a plurality of photoconductors 101, the belt 16, primary transfer rollers 102, and a control unit 103. It is preferable that the transfer device 10 further includes a detector 104, a calculator 105, and a conveyance speed controller 106. It is more preferable that the transfer device 10 further includes a distance changer 107. Furthermore, it is more preferable that the transfer device 10 further includes a driving unit 108, a rotational speed measurement unit 109, and a rotational speed controller 110.

The control unit 103 causes at least one of the primary transfer rollers 102 to press against the photoconductor 101 to execute a process to shill the mode. For example, the control unit 103 is implemented by the controller 20.

The detector 104 executes a process to detect the mark 40. For example, the detector 104 is implemented by the optical sensor 17.

The calculator 105 executes a process to calculate the conveyance speed of the belt 16 based on the results of detection by the detector 104. For example, the calculator 105 is implemented by the by the controller 20.

The conveyance speed controller 106 performs a conveyance speed control procedure to control the conveyance speed of the belt 16 based on the results of calculation by the calculator 105. For example, the conveyance speed controller 106 is implemented by the controller 20.

The distance changer 107 performs a distance changing procedure to change the distance between the detector 104 and the belt 16. For example, the distance changer 107 is implemented by the controller 20.

The driving unit 108 performs a driving procedure for rotating the driving roller 19 to rotate the belt 16. For example, the driving unit 108 is implemented by the driving motor 60.

The rotational speed measurement unit 109 performs a rotational speed measurement procedure to measure the rotational speed of the driving roller 19. For example, the rotational speed measurement unit 109 is implemented by the encoder 61.

The rotational speed controller 110 performs a rotational speed control procedure to control the rotational speed of the driving roller 19 based on the measurement result of the rotational speed measurement unit 109. For example, the rotational speed controller 110 is implemented by the controller 20.

Due to the above-described configuration, the transfer device 10 may shift the mode without shilling to the state such as the fully separated state.

In a state such as the fully separated state, it may be difficult to control the conveyance speed of the belt 16. For this reason, downtime may occur in the fully separated state. As a result, the productivity of the image forming apparatus decreases due to the occurrence of the downtime. Further, printing may not be continuously performed in the downtime.

On the other hand, the transfer device 10 enhances the productivity of the image forming apparatus by performing control so that the fully separated state does not occur.

Other Embodiment

The transfer device and the image forming apparatus may be a plurality of devices or apparatuses. In other words, the transfer device and the image forming apparatus may be configured such that a plurality of devices or apparatuses perform processing in a distributed manner, in a redundant manner, or in parallel.

The image forming apparatus may include a device other than the transfer device. For example, the image forming apparatus may include a device that performs image formation or information processing in addition to the transfer device.

The transfer device executes the control method by a program. The control method is implemented by causing an arithmetic unit, a control unit, and a storage unit included in the transfer device to cooperate with each other to execute processing.

It is therefore to be understood that the disclosure of the present specification may be practiced otherwise by those skilled in the art than as specifically described herein. Such embodiments and variations thereof are included in the scope and gist of the embodiments of the present disclosure and are included in the embodiments described in claims and the equivalent scope thereof.

The above-described embodiments are illustrative and do not limit the present invention. Thus, numerous additional modifications and variations are possible in light of the above teachings. For example, elements and/or features of different illustrative embodiments may be combined with each other and/or substituted liar each other within the scope of the present invention. Any one of the above-described operations may be performed in various other ways, for example, in an order different from the one described above.

The functionality of the elements disclosed herein may be implemented using circuitry or processing circuitry which includes general purpose processors, special purpose processors, integrated circuits, application specific integrated circuits (ASICs), digital signal processors (DSPs), field programmable gate arrays (FPGAs), conventional circuitry and/or combinations thereof which are configured or programmed to perform the disclosed functionality. Processors are considered processing circuitry or circuitry as they include transistors and other circuitry therein. In the disclosure, the circuitry, units, or means are hardware that carry out or are programmed to perform the recited functionality. The hardware may be any hardware disclosed herein or otherwise known which is programmed or configured to carry out the recited functionality. When the hardware is a processor which may be considered a type of circuitry, the circuitry, means, or units are a combination of hardware and software, the software being used to configure the hardware and/or processor.

What is claimed:

1. A transfer device comprising:

a plurality of photoconductors;

a belt;

a plurality of primary transfer rollers disposed for the plurality of photoconductors, respectively, the plurality of primary transfer rollers being configured to bring the belt into contact with or separate the belt from the plurality of photoconductors;

control circuitry configured to cause at least one of the plurality of primary transfer rollers to press against a corresponding at least one of the plurality of photoconductors to shift a printing mode;

a driving roller;

a driving source configured to cause the driving roller to rotate to convey the belt; and an encoder configured to measure a rotational speed of the driving roller, wherein the control circuitry is configured to control the rotational speed of the driving roller based on a result of measurement by the encoder, wherein the control circuitry is configured to control the rotational speed of the driving roller based on the rotational speed which has been measured, alone, in response to a determination that marks on the belt are not accurately detectable.

2. The transfer device according to claim 1, further comprising:

a detector to detect the marks on the belt, wherein the control circuitry is further configured to:

calculate a conveyance speed of the belt based on a result of detection by the detector; and control the conveyance speed of the belt based on a result of calculation by the control circuitry.

3. The transfer device according to claim 2, wherein the detector is disposed at a position within 10 centimeters from the plurality of primary transfer rollers or a support to support the belt.

4. The transfer device according to claim 2, wherein the control circuitry is configured to change a distance between the detector and the belt.

5. The transfer device according to claim 2, wherein the control circuitry is configured to determine that the marks are not accurately detectable when an output of the detector is less than or equal to a threshold value.

6. The transfer device according to claim 5, wherein the driving source is to change a distance between the detector and the belt and move the plurality of primary transfer rollers.

7. An image forming apparatus comprising the transfer device according to claim 1.

8. A transfer device comprising:

a plurality of photoconductors;

a belt;

a plurality of primary transfer rollers disposed for the plurality of photoconductors, respectively, the plurality of primary transfer rollers being configured to bring the belt into contact with or separate the belt from the plurality of photoconductors;

means for controlling to cause at least one of the plurality of primary transfer rollers to press against a corresponding at least one of the plurality of photoconductors to shift a printing mode;

a driving roller;

a driving source configured to cause the driving roller to rotate to convey the belt; and an encoder configured to measure a rotational speed of the driving roller, wherein the means for controlling controls the rotational speed of the driving roller based on a result of measurement by the encoder, wherein the means for controlling controls the rotational speed of the driving roller based on the rotational speed which has been measured, alone, in response to a determination that marks on the belt are not accurately detectable.

9. The transfer device according to claim 8, further comprising:

a detector to detect the marks on the belt, wherein the means for controlling further:

calculates a conveyance speed of the belt based on a result of detection by the detector; and controls the conveyance speed of the belt based on a result of calculation of the conveyance speed.

10. The transfer device according to claim 9, wherein the detector is disposed at a position within 10 centimeters from the plurality of primary transfer rollers or a support to support the belt.

11. The transfer device according to claim 9, wherein the means for controlling is configured to change a distance between the detector and the belt.

12. The transfer device according to claim 9, wherein the means for controlling is for determining that the marks are not accurately detectable when an output of the detector is less than or equal to a threshold value.

13. The transfer device according to claim 12, wherein the driving source is to change a distance between the detector and the belt and move the plurality of primary transfer rollers.

14. An image forming apparatus comprising the transfer device according to claim 8.

* * * * *